US011199048B2

(12) United States Patent
Watkins et al.

(10) Patent No.: US 11,199,048 B2
(45) Date of Patent: Dec. 14, 2021

(54) HANDLE STRUCTURE AND ASSEMBLY FOR BOTTOM RAIL OF WINDOW SHADING

(71) Applicant: HUNTER DOUGLAS INC., Pearl River, NY (US)

(72) Inventors: Richard Watkins, Lake Luzerne, NY (US); Kenneth W. Witherell, Golden, CO (US); Stephen P. Smith, Denver, CO (US); Michael True, Thornton, CO (US); Galen B. Rhodes, Henderson, CO (US); Tim Daviau, Broomfield, CO (US); Kent Smith, Broomfield, CO (US); Paula Cerna, Broomfield, CO (US)

(73) Assignee: Hunter Douglas Inc., Pearl River, NY (US)

( * ) Notice: Subject to any disclaimer, the term of this patent is extended or adjusted under 35 U.S.C. 154(b) by 451 days.

(21) Appl. No.: 16/066,801

(22) PCT Filed: Jan. 25, 2017

(86) PCT No.: PCT/US2017/014883

§ 371 (c)(1),
(2) Date: Jun. 28, 2018

(87) PCT Pub. No.: WO2017/132227

PCT Pub. Date: Aug. 3, 2017

(65) Prior Publication Data

US 2018/0371834 A1 Dec. 27, 2018

Related U.S. Application Data

(60) Provisional application No. 62/286,894, filed on Jan. 25, 2016, provisional application No. 62/286,890, filed on Jan. 25, 2016.

(51) Int. Cl.
*E06B 9/78* (2006.01)
*E06B 9/322* (2006.01)
(Continued)

(52) U.S. Cl.
CPC ..... *E06B 9/78* (2013.01); *E06B 9/264* (2013.01); *E06B 9/32* (2013.01); *E06B 9/322* (2013.01);
(Continued)

(58) Field of Classification Search
CPC ... E06B 9/78; E06B 9/32; E06B 9/322; E06B 9/40; E06B 9/42; E06B 9/264;
(Continued)

(56) References Cited

U.S. PATENT DOCUMENTS 1,892,087 A 12/1932 Stuber
2,233,516 A * 3/1941 Cecil ..... E06B 9/78 16/438
(Continued)

FOREIGN PATENT DOCUMENTS

AU 201614398 S 10/2016
EP 1353037 A2 10/2003
WO 2013129919 A1 9/2013

OTHER PUBLICATIONS

International Search Report and Written Opinion for PCT Application No. PCT/US2017/014883 dated Mar. 29, 2017, 12 pages.

*Primary Examiner* — Katherine W Mitchell
*Assistant Examiner* — Abe Massad
(74) *Attorney, Agent, or Firm* — Hoffman Warnick LLC

(57) ABSTRACT

A pivotable handle for an architectural covering is provided. The handle (400) includes first and second members (408, 410) pivotably connected together at a hinge assembly (460). The first member (408) may be operable to connect the handle (400) to a movable rail (512). The second
(Continued)

member (410) pivots between stored and use positions. In a stored position, the second member (410) may extend adjacent the first member (408). In a use position, the second member (410) may be pivoted away from the first member (408) to extend the movable rail (512) across an architectural structure. The handle includes a biasing member (470) operable to bias the second member (410) towards the first member (408).

23 Claims, 18 Drawing Sheets

(51) Int. Cl.

| | |
|---|---|
| ***E06B 9/42*** | (2006.01) |
| ***E06B 9/32*** | (2006.01) |
| ***E06B 9/264*** | (2006.01) |
| *E06B 9/24* | (2006.01) |

(52) U.S. Cl.
CPC ..... *E06B 9/42* (2013.01); *E06B 2009/2435* (2013.01); *E06B 2009/3222* (2013.01)

(58) Field of Classification Search
CPC ..... E06B 2009/2435; E06B 2009/3222; E06B 9/388; E06B 2009/425; E05B 5/003
See application file for complete search history.

(56) References Cited

U.S. PATENT DOCUMENTS 2,280,969 A * 4/1942 O'malley ..... E06B 9/78 160/384
2,624,906 A 1/1953 Foster
2,702,081 A * 2/1955 North ..... A47H 23/06 160/120
2,715,243 A * 8/1955 Koll ..... E05B 1/0015 16/445
2,767,424 A * 10/1956 Knuepfer ..... A45C 13/26 16/445
2,852,424 A * 9/1958 Reinhart ..... F16F 1/366 156/154
2,865,044 A 12/1958 Bielek
3,362,053 A * 1/1968 Land ..... E06B 9/78 24/564
3,470,764 A 10/1969 Frymire
3,581,798 A 6/1971 Malamed
3,692,155 A 9/1972 Laurita
4,687,041 A 8/1987 Anderson
4,831,678 A 5/1989 Dietsche
4,884,615 A 12/1989 Hsu
4,911,348 A 3/1990 Rasor et al.
5,265,307 A 11/1993 Hull et al.
5,706,876 A * 1/1998 Lysyj ..... E06B 9/262 160/84.05
5,937,929 A 8/1999 Chen
6,024,154 A 2/2000 Wang et al.
6,029,734 A 2/2000 Wang et al.
6,536,503 B1 3/2003 Anderson et al.
7,175,377 B2 2/2007 Womack et al.
7,389,565 B2 6/2008 Cheng
7,451,525 B2 11/2008 Willems
7,802,608 B2 9/2010 Anderson et al.
D647,777 S 11/2011 Franssen
8,070,660 B2 * 12/2011 Seidel ..... G09F 11/325 492/15
8,739,853 B2 6/2014 Judkins
9,322,210 B2 4/2016 Lukosiunas et al.
D842,677 S 3/2019 Spray et al.
10,487,572 B2 * 11/2019 Smith ..... E06B 9/322
D910,413 S 2/2021 Spray et al.
2002/0157796 A1 10/2002 Judkins
2002/0174961 A1 11/2002 Anderson et al.
2004/0131439 A1 7/2004 Womack et al.
2007/0023151 A1 2/2007 Judkins
2007/0084567 A1 4/2007 Chen
2008/0115894 A1 5/2008 Cech et al.
2008/0129054 A1 * 6/2008 Tremble ..... E05B 15/102 292/33
2009/0106942 A1 4/2009 Dell'orfano
2012/0097349 A1 4/2012 Chen
2012/0222824 A1 * 9/2012 Lin ..... E06B 9/262 160/25
2012/0227912 A1 9/2012 Anderson et al.
2012/0267056 A1 10/2012 Ko
2014/0216666 A1 8/2014 Smith et al.
2015/0013921 A1 1/2015 Franssen
2015/0020982 A1 1/2015 Anderson et al.
2015/0034262 A1 2/2015 Franssen
2015/0047792 A1 2/2015 Lukosiunas et al.
2015/0059991 A1 3/2015 Kwak
2015/0197984 A1 7/2015 Anderson et al.
2015/0259978 A1 * 9/2015 Lin ..... E06B 9/78 160/370.22
2016/0010389 A1 1/2016 Anderson et al.
2016/0305183 A1 * 10/2016 Jelic ..... E06B 9/264
2017/0211322 A1 7/2017 Smith et al.

* cited by examiner

HANDLE STRUCTURE AND ASSEMBLY FOR BOTTOM RAIL OF WINDOW SHADING

CROSS REFERENCE TO RELATED APPLICATIONS

This application claims the benefit of priority and an earlier filing date, per the accompanying Application Data Sheet under 35 USC § 119(e) and MPEP § 211, of U.S. Provisional Patent Application No. 62/286,890, filed Jan. 25, 2016, entitled "Handle Structure for Bottom Rail of Window Shading," and U.S. Provisional Patent Application No. 62/286,894, filed 25 Jan. 2016 and entitled "Pivotable Handle for an Architectural Covering," both of which are hereby incorporated by reference in their entirety.

BACKGROUND

1. Technical Field

The present disclosure relates to window shades, and more particularly, to a handle structure for a bottom rail of a window shading. The present disclosure can be adapted for use with, e.g., window shadings with two shading sheets (alternatively referred to as panels or supports) coupled together by several vanes.

2. Background Art

Architectural coverings, such as coverings for structures, including walls and openings, such as windows, doorways, archways, and the like, have taken numerous forms for many years. Some coverings include a retractable shade material that is movable between an extended position and a retracted position. A movable rail typically is attached to an edge of the shade material to facilitate extension of the shade material across an architectural structure/feature and to maintain the shade material in a desired configuration. Some movable rails include a handle that facilitates a user moving the movable rail across the architectural structure/feature. Use of some handles may result in a user touching the shade material during extension of the movable rail across the architectural structure/feature, which may not be desirable.

As depicted in FIGS. 1-3, conventional window shading assemblies may include a double-panel shading having a front facing 102 and a rear facing 104 and a plurality of vanes 106 extending therebetween. It will be appreciated that as used herein, a "facing" may be in the form of a sheet or panel or other type of support element for supporting the vanes, such as a support element or "support" having a distinct width, e.g., similar to the width of the vanes. A shading element 108 which includes front and rear facings 102, 104, can be wound about a roller 110 for selectably rolling and unrolling shading element 108. Roller 110 can be positioned within a headrail or casing 112 so that shading element 108, when rolled about roller 110 in a retracted position, is substantially contained within casing 112. Shading element 108 can include, at a bottom end opposite the end of shading element 108 coupled to roller 110, a bottom rail 114 for receiving front and rear facings 102, 104, in addition to defining a lower vertical position of shading element 108. Bottom rail 114 can also include, e.g., at least one groove 115 formed therein at any desired lateral position thereof. Roller 110 can be mounted to a particular wall, window frame, architectural fixture, etc., in a conventional manner, e.g., by way of endcaps or brackets 112. Each facing 102, 104, in shading element 108 can be composed of a high transparency material, with vanes 106 being composed of a less translucent fabric and spaced apart at even and/or uneven spatial intervals. Shading element 108 can be mounted to roller 110 such that when roller 110 is rotated to a first position, front and rear facings 102, 104 can hang from opposing front and rear sides of the assembly.

As shown in FIG. 2, front and rear facings 102, 104 of a window shading 120 can be spaced apart with vanes 106 extending between front and rear facings 102, 104, thus providing maximum view-through as shown in FIG. 2. When roller 110 is rotated in a first direction by an actuating device (e.g., a cord 118), movement of roller 110 can raise rear facing 104 (which may face externally toward the window), relative to front facing 102 (which may face internally toward the inside of the room where the shading is hung). The first effect of such rotation is to adjust the angle of vanes 106 with respect to front and rear facings 102, 104, and thereby bring front and rear facings 102, 104 close together with vanes 106 and obstructing or blocking an observer's view through front and rear facings 102, 104. Further rotation of roller 110 in the same direction with cord 118 can then roll both facings 102, 104 onto roller 110, lifting shading element 108 from the window area as in a conventional roller shade. Unrolling the shading element 108 of window shading 120 again can reverse this process. For example, front facing 102 can be lowered to cover the window area, then, with a final partial turn of roller 110, front and rear facings 102, 104 can be shifted with respect to each other such that vanes 106 are tilted to provide view-through. Bottom rail 114 can act to maintain the facings 102, 104 in smooth, level planes, by tension, and can induce vanes 106 to flex as needed for their tilting by providing additional weight.

It is desirable to eliminate operating cords (e.g., cord 118 of FIGS. 1-3) for window shade assemblies for a variety of reasons. For example, cords and cord loops of conventional window shade assemblies may become entangled. Many alternative systems without cords and cord loops have been proposed, but most are significantly more expensive than existing window shade assemblies. Actuating the shade with motorized components can also potentially eliminate the presence of cords, in addition to providing other benefits such as remote control or timer-driven deployment, but these alternatives are also more expensive than conventional assemblies. The cost of these motors is often as much as that of the shade itself and so these have been restricted to only the most expensive of applications.

BRIEF SUMMARY

Embodiments of the present disclosure can provide a handle structure for a bottom rail of a window covering such as a window shading. Embodiments of the present disclosure can be used, e.g., with window shadings which include opposing facings coupled to the bottom rail at opposing front and rear sides of the bottom rail. The two opposing facings, in some cases, can be coupled together by a group of vanes for providing variable transparency of the window shading.

A handle structure according to embodiments of the present disclosure can include, e.g., a handle member with a first end pivotably coupled to the bottom rail, and a second end for gripping the handle member. A biasing element can bias the handle member to a closed position such that the handle member is in a stored position such as with the second end of the handle member proximal to the front side of the bottom rail. In alternative embodiments, the biasing element can be embodied as a magnet which couples the handle member to the bottom rail. Applying a downward force to the handle member can pivot the handle member away from the bottom rail, in opposition to the biasing element. In turn, the pivot coupling between the handle member and the bottom rail can allow a downward force applied near the front end of the bottom rail to be transferred to the rear side of the bottom rail.

Embodiments of the present disclosure can also combine the handle structure with the remainder of a window shading assembly, e.g., by including the handle structure formed on and/or coupled to the bottom rail of the window shading assembly. In operation, embodiments of the present disclosure can allow a user to adjust a position of the bottom rail relative to a roller of the window shading assembly, and/or an amount of light transmission through the window shading assembly.

The present disclosure further provides a pivotable handle for an architectural covering. The handle may be coupled to a movable rail to move the movable rail across an architectural structure. In an example embodiment, the handle includes a handle member pivotable between use and stored positions. In a use position, the handle member may permit a user to extend the movable rail across an architectural structure by engaging an element spaced apart from the main body of the movable rail. The handle member may be biased to a stored position in which the handle member extends adjacent the movable rail.

This summary of the disclosure is given to aid understanding, and one of skill in the art will understand that each of the various aspects and features of the disclosure may advantageously be used separately in some instances, or in combination with other aspects and features of the disclosure in other instances. Accordingly, while the disclosure is presented in terms of embodiments, it should be appreciated that individual aspects of any embodiment can be claimed separately or in combination with aspects and features of that embodiment or any other embodiment. The present disclosure of certain embodiments is merely exemplary in nature and is in no way intended to limit the claimed invention or its applications or uses. It is to be understood that other embodiments may be utilized and that structural and/or logical changes may be made without departing from the spirit and scope of the present disclosure.

The present disclosure is set forth in various levels of detail in this application and no limitation as to the scope of the claimed subject matter is intended by either the inclusion or non-inclusion of elements, components, or the like in this summary. In certain instances, details that are not necessary for an understanding of the disclosure or that render other details difficult to perceive may have been omitted. Moreover, for the purposes of clarity, detailed descriptions of certain features will not be discussed when they would be apparent to those with skill in the art so as not to obscure the description of the present disclosure. It should be understood that the claimed subject matter is not necessarily limited to the particular embodiments or arrangements illustrated herein, and the scope of the present disclosure is defined only by the appended claims.

The illustrative aspects of the present disclosure are designed to solve the problems herein described and/or other problems not discussed.

BRIEF DESCRIPTION OF THE DRAWINGS

These and other features of this disclosure will be more readily understood from the following detailed description of the various aspects of the disclosure taken in conjunction with the accompanying drawings that depict various embodiments of the disclosure, in which.

Figure 1:
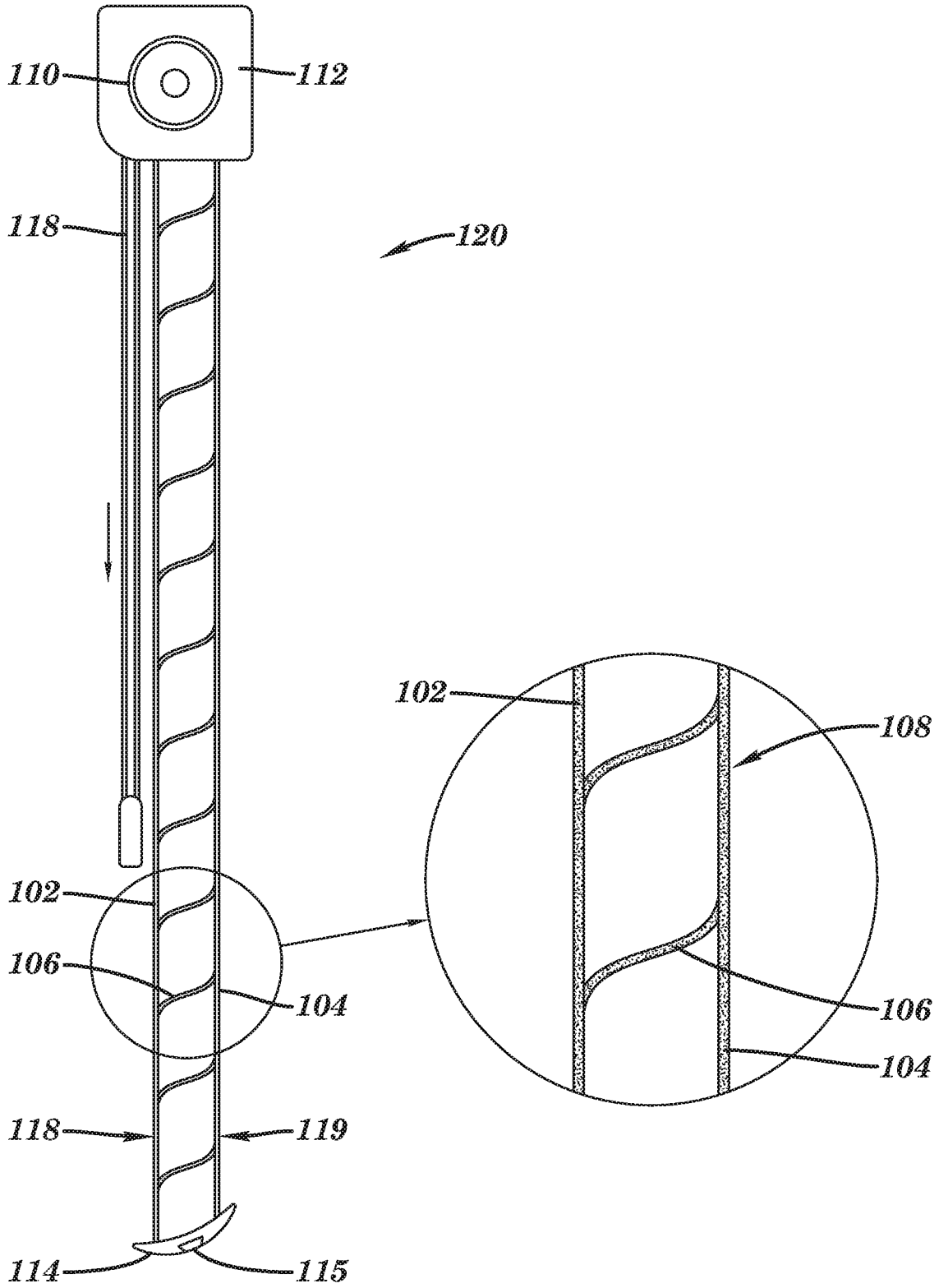
FIG. 1 PRIOR ART
FIG. 1 shows a side view of a conventional cord-actuated window shading assembly.

It is noted that the drawings of the disclosure are not necessarily to scale. The drawings are intended to depict only typical aspects of the disclosure, and therefore should not be considered as limiting the scope of the disclosure. In the drawings, like numbering represents like elements between the drawings.

DETAILED DESCRIPTION

Embodiments of the present disclosure provide a handle structure for window shades or coverings. In particular, embodiments of the present disclosure provide the safety of cordless shadings with an intuitive mechanism for actuating (i.e., opening or closing) of a window covering. Embodiments of the present disclosure can include, e.g., a handle member coupled to the bottom rail at a point proximal to one side of the bottom rail to actuate opening or closing of the window covering. As is discussed herein, the window covering may be in the form of a window shading which generally includes two facings (alternatively referred-to herein as panels) coupled to a roller at diametrically opposing front and rear radial sides of the roller. A plurality of vanes can be positioned between the facings, with a bottom rail being positioned at a lower end of the facings. Mounting elements of the window shade can include, e.g., a bracket with end caps or other fixtures for engaging one or more elements of an architectural opening in which the shading is to be mounted or deployed.

A handle member in embodiments of the present disclosure can be pivotably coupled to the bottom rail of a window covering. A biasing element (e.g., one or more springs including, e.g., a helical torsion spring, leaf spring, and/or other component for providing a mechanical biasing force) can be coupled between the bottom rail and the handle member such that the handle member is maintained in a stored position, such as with the handle extending toward the front facing of the window covering. Applying a downward force to the handle member can overcome the biasing force applied to the handle member at its pivotable coupling, such that the handle member extends downwardly. Coupling of the handle member to the bottom rail at a point proximal to the rear facing of the window covering (in contrast with other more centrally located positions along the bottom surface of the bottom rail) causes the downward force on the handle to be further applied to the rear side of the bottom rail (in contrast with a more uniformly directed force along the bottom surface of the bottom rail, which is generally horizontal). When a ratcheting element is provided in the roller to control movement of the roller, the pivotable coupling of the handle member at a point proximal to the rear side of the bottom rail allows optimal application of force to the ratcheting member to actuate the ratcheting element. Where a roller is coupled to the bottom rail through a rear facing of a window shading, the downward force applied through the rear facing can cause a roller of the shadings to rotate to adjust transparency of the shadings (by adjusting the relative positions of the front and rear facings and thereby adjusting the angles of the vanes extending between the front and rear facings) and/or to allow retraction of the shading onto the roller. However, it will be appreciated that a window shading is only one form of a window covering to which the disclosure may be applied. It will further be appreciated that in the illustrated embodiments of a window covering in the form of a window shading, opening and closing of the window shading to adjust light transmission therethrough is achieved by moving the rear facing downward to move upper ends of the vanes downwardly from a closed configuration (in which the vanes are blocking light transmission through the front and rear facings). However, in a different configuration in which the upper ends of the vanes are coupled to the front facing, then downward force would be applied to the front facing, and the handle member optimally would be pivotably coupled to the bottom rail at a point proximal to the front facing. Thus, it will be appreciated that directional references are exemplary and to be taken in context of the example shading being described, and to be understood relative to other directional references in a given example.

Figure 4:
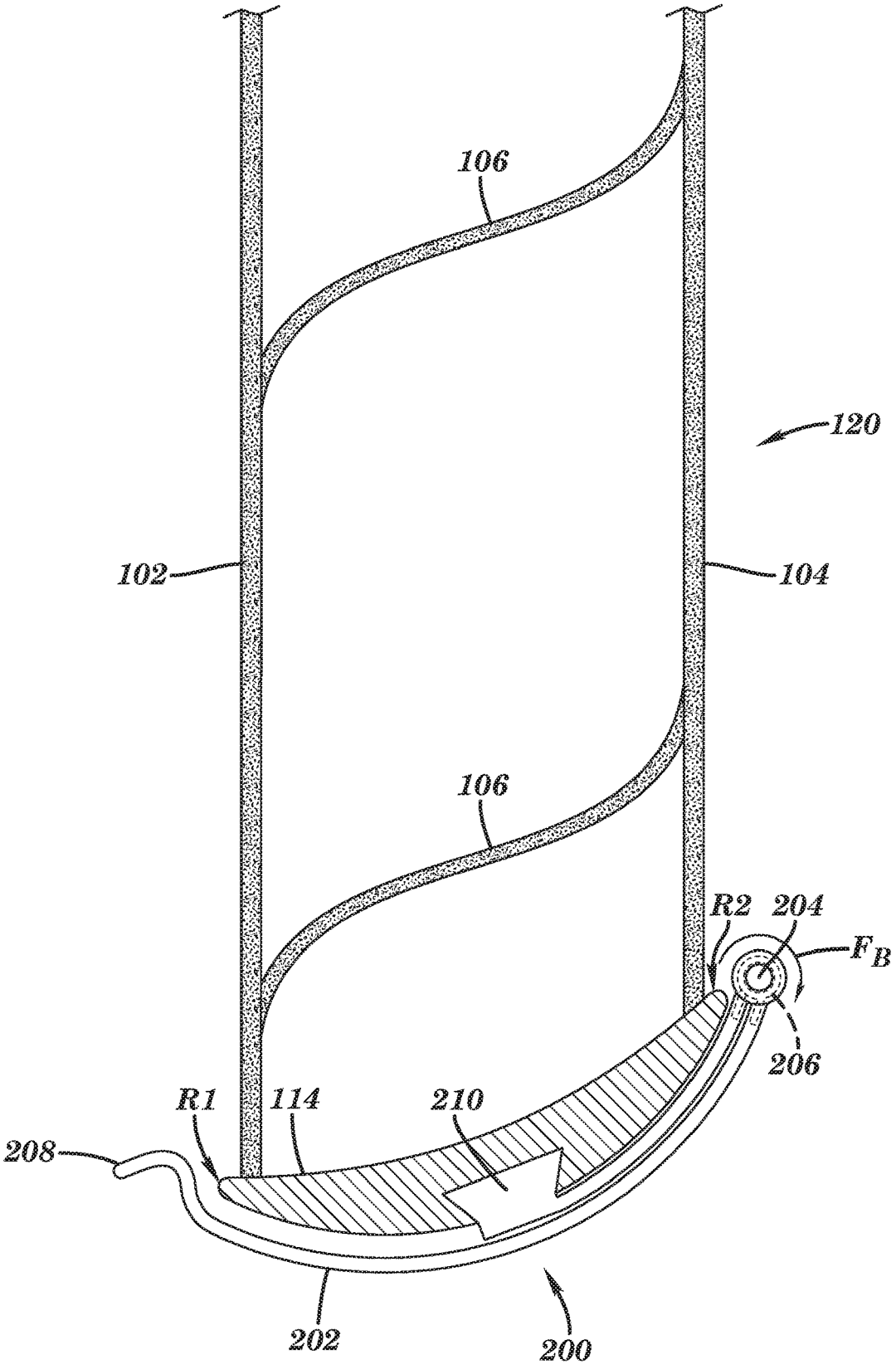
FIG. 4 shows a side view of a handle structure of a window shading assembly according to embodiments of the present disclosure.

Referring to FIG. 4, a handle structure 200 for bottom rail 114 of window shading 120 is shown. As discussed elsewhere herein, window shading 120 can include front and rear facings 102, 104, coupled to bottom rail 114 opposing front and rear sides $R_1$, $R_2$ of bottom rail 114. Although front and rear facings 102, 104 and front and rear sides $R_1$, $R_2$, are identified herein such that the "front" faces leftward and the "rear" faces rightward, it is understood that these orientations may be reversed and/or modified based on an intended application of handle structure 200. Handle structure 200 can include a handle member 202 with two opposing ends respectively associated with front and rear facings 102, 104. Handle member 202 can substantially correspond to a contour of bottom rail 114 between front and rear facings 102, 104, e.g., can be contoured to have a substantially curved or crescent-shaped geometry where the lowermost surface of bottom rail has a substantially curved or crescent-shaped contour. One end of handle member 202 can be pivotably coupled to a corresponding side of bottom rail 114 (e.g., a rear end of handle member 202 can be pivotably coupled to rear side $R_2$ of bottom rail 114) through a pivot coupling 204 such as a hinge, rotatable joint, pivot bearing, etc. A biasing element 206 of pivot coupling 204 can position handle member 202 in a desired position when window shading 120 is in a non-use or rest position, e.g., not being moved, adjusted, etc. For instance, handle member 202 may be positioned in a rest or non-use position substantially adjacent to bottom rail 114, such as nested along or about bottom rail 114, when handle member 202 is not being used. If desired, in the rest or non-use position, handle member 202 may be closely positioned along or against bottom rail 114 to be unobtrusive. For example, an observer of window shading 120 with handle structure 200 coupled thereto may observe only a portion of handle member 202 proximal to one end of bottom rail 114, with the remainder of handle member 202 being obscured from view by front-facing surfaces, structures, etc., of bottom rail 114, front facing 102, vanes 106, etc. A handle 208 can be positioned on and/or formed within handle member 202 at an opposing end from pivot coupling 204. Handle 208 can protrude outward from bottom rail 114 of window shading 120 when biasing element 206 biases handle member 202 into a closed position. The operation of biasing element 206 and position of handle 208 can allow handle structure 200 to be obscured from view when window shading 120 is not being adjusted, and can allow only handle 208 to be directly visible as discussed elsewhere herein. Although handle 208 is shown in FIGS. 4, 7, and 9-11 as having a particular shape for the purposes of example, it is understood that handle member 202 can include any currently-known or later-developed implement for gripping and/or directing a load to handle structure 200.

Biasing element 206 can bias handle structure 202 to a closed position such that handle member 202 contacts or otherwise is positioned proximal to bottom rail 114. Bottom rail 114 can be provided as a single, rigid element and/or can include a group of individual members for accommodating movement of one facing 102, 104, relative to another. Biasing element 206 can include any currently known or later-developed structure, material, component, etc., for forcibly orienting one or more components in a particular direction. As examples, biasing element 206 can be provided as a deformable, torsion-based device capable of imparting a rotational biasing force which can be temporarily overcome by applying a counteracting rotational force in the opposite direction. As examples of torsion-based and non-torsion-based embodiments, biasing element 206 can include and/or be provided as a helical or non-helical, torsion spring, a leaf spring (e.g., a mechanically biased coupling component with tangs extending in parallel at opposite orientations), a torsion bar, a magnetic assembly, a resinous material for biasing handle member 202 against bottom rail 114, etc. Generally, biasing element 206 can be provided as any structure, material, component, etc., capable of mechanically biasing handle member 202 in a closed position relative to bottom rail 114. As illustrated in FIG. 4, a biasing force FB can pivotably bias handle member 202 into a closed positon such that handle member 202 extends substantially parallel with a separation between front and rear facings 102, 104 of window shading 120.

Figure 2:
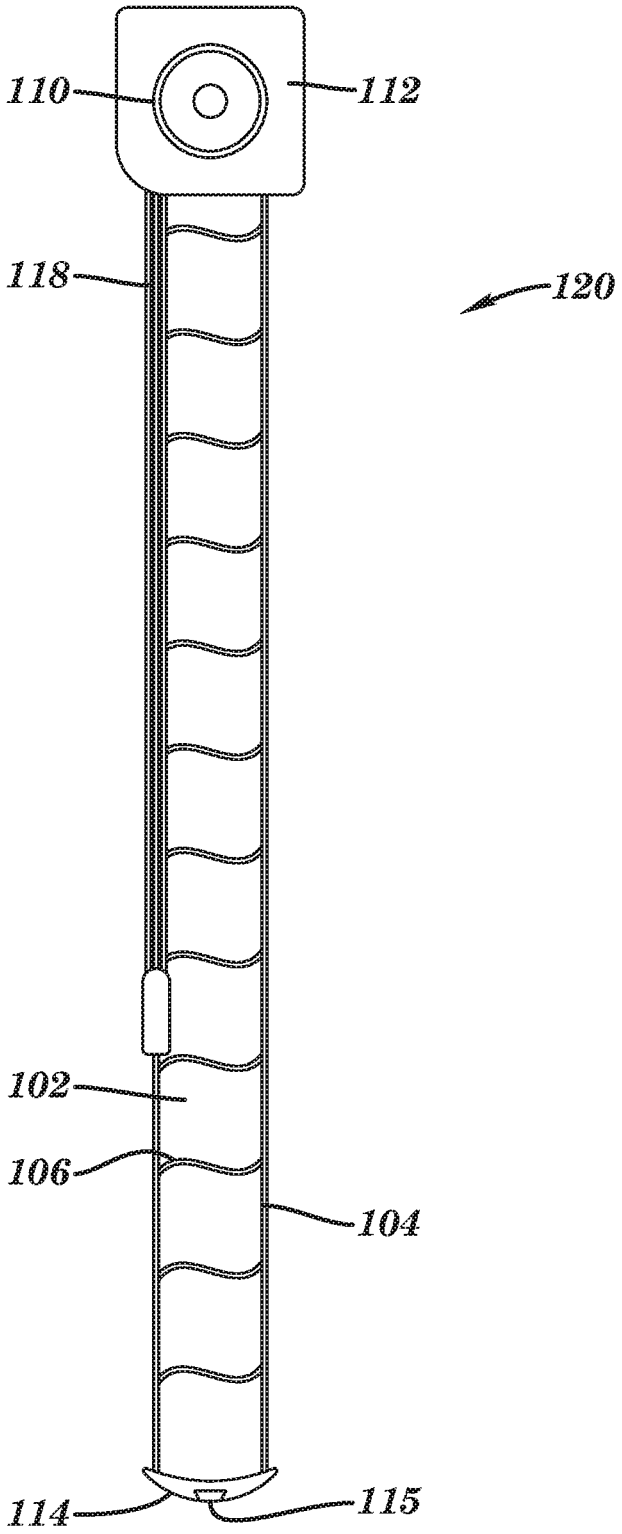
FIG. 2 PRIOR ART
FIG. 2 shows a side view of the conventional cord-actuated window shading assembly with two facings in an open position.
Figure 3:
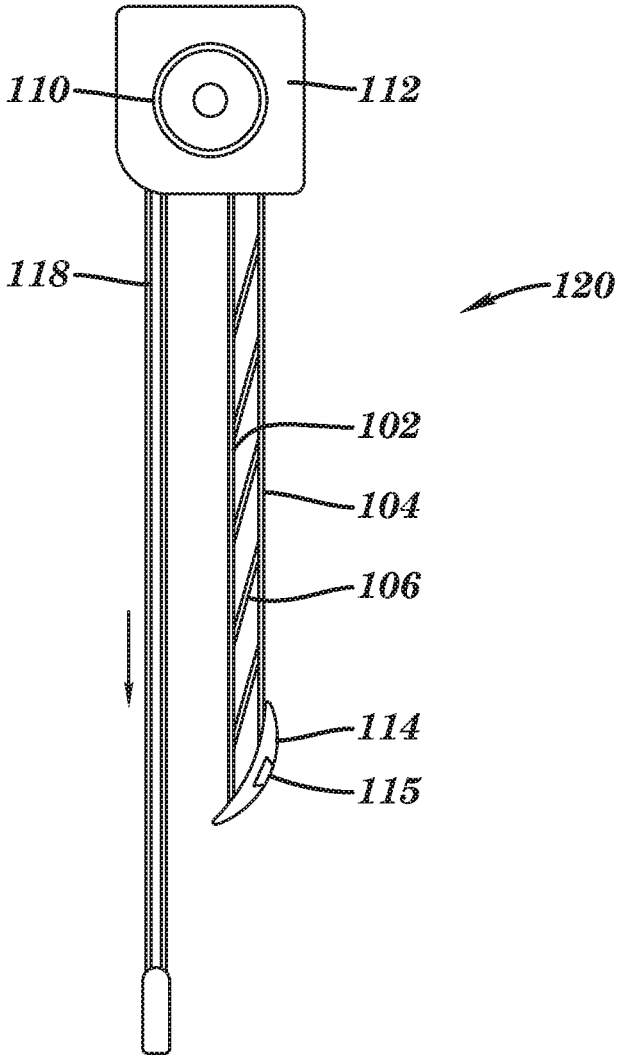
FIG. 3 PRIOR ART
FIG. 3 shows a side view of the conventional cord-actuated window shading assembly with two facings in a closed position.

Handle member 202 and bottom rail 114 can be mechanically coupled to each other by any currently-known or later-developed solution, including those which introduce additional structural elements or provide a direct mechanical engagement. To this extent, it is understood that handle structure 200 can be installed on bottom rails 114 of existing window shadings 120 by a variety of approaches used individually or in combination with each other. For example, a mounting plate can be interposed between pivot coupling 204 and bottom rail 114. Handle member 202 can also be coupled and/or bonded to handle structure 200 by use of, e.g., fasteners, bonding agents, matingly engaged components, etc., which may include or be structurally independent from pivot coupling 204. For example, biasing element 106 may be directly coupled to bottom rail 114, e.g., during manufacture, thus removing the need for mounting plates and/or other intervening structures. Handle member 202, when not in use, can maintain the same position relative to window shade 120, even as facings 102, 104 are actuated through handle member 202 of handle structure 200. One or more fixing members 210 can mechanically join handle structure 200 to bottom rail 114. Fixing member(s) 210 can additionally or alternatively define a structural component of bottom rail 114 and/or handle structure 200. Fixing member 210 can be a structurally distinct component from bottom rail 114 such that, e.g., handle structure 200 can be fixedly coupled to bottom rail 114. In such an embodiment, handle member 202 can pivot relative to fixing member 210 in addition to bottom rail 114. Further, biasing element 206 can mechanically bias handle member 202 based on its position relative to fixing member 210. In the side-view of FIG. 4, handle member 202 can be shaped for engagement with corresponding portions of bottom rails 114 in a conventional shading assembly. For example, handle member 202 may be configured to engage groove 115 (FIGS. 1-3) of bottom rail 114 (such as being slid within groove 115), such that handle structure 200 can be added to and/or removed from window shading 120 as desired.

Figure 5:
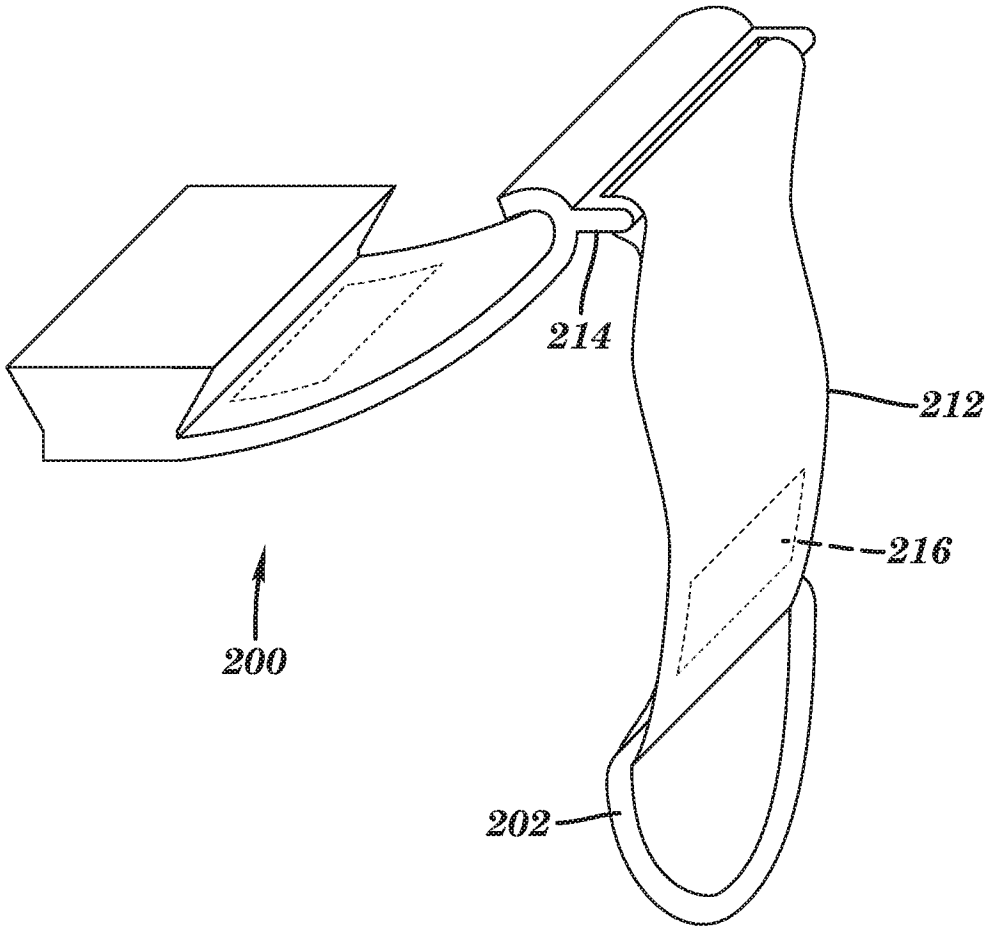
FIG. 5 shows a perspective view of an alternative handle structure according to embodiments of the present disclosure.
Figure 6:
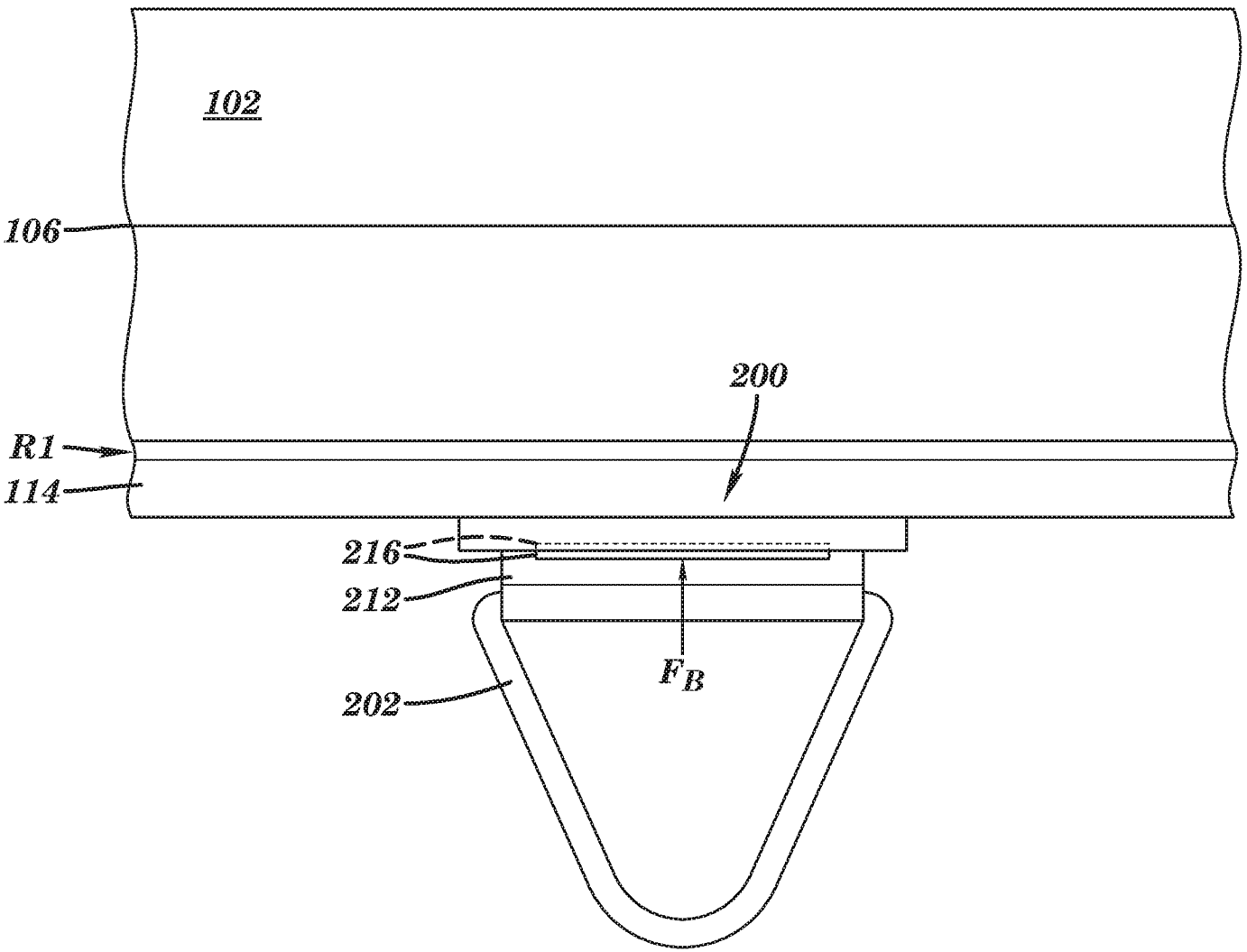
FIG. 6 shows a front view of an alternative handle structure of a window shading assembly according to embodiments of the present disclosure.

Turning to FIGS. 5 and 6, an alternative embodiment of handle structure 200 is shown. Here, handle member 202 can include a flexible member 212 coupled thereto. A mounting element 214 may be provided to couple flexible member 212 to handle member 202. Flexible member 212 can be embodied as a non-rigid element for directing a force, e.g., a non-rigid handle, a cord (preferably of limited length, such as less than approximately 6 inches (15.2 cm)) coupled to bottom rail 114 (e.g., through mounting element 214), a fabric fixture, etc. As examples, flexible member 212 can include a non-rigid material such as a fabric, a flexible plastic, leather, etc. In any event, flexible member 212 can have a length substantially less than that of conventional cords, e.g., less than about 7 inches (17.8 cm).

Other embodiments of biasing elements for maintaining a handle structure 200 in a desired position, such as a non-use or closed position, are within the scope of the present disclosure. For instance, a magnet or elastic element which draws handle structure 200 towards the desired non-use position may be used. As shown in FIG. 5, biasing element 206 (FIG. 4) can include a magnet 216. Magnet 216 may be used in conjunction with flexible member 212 of FIGS. 5 and 6, handle member 202 of FIG. 4, or any other type of handle member. As shown alternatively in a disengaged position in FIG. 5 and directly visible to an observer in FIG. 6, magnet 216 can be positioned, e.g., in flexible member 212 for magnetically engaging another element such as a magnet, striker plate, etc., composed of steel or other ferrous material positioned on and/or embedded within bottom rail 114. In alternative embodiments, it is understood that ferrous material may be included with flexible member 212 with magnet 216 being positioned within and/or coupled to bottom rail 114. Flexible member 212 and can alternatively include and/or be substituted for an elastic member or similar device (e.g., an elastic cord), etc., coupled to bottom rail 114 and/or mounting element 214 proximal to any desired position of bottom rail 114. For example, magnet 216 can be positioned proximal to front side R1, rear side R2, at approximately the middle of bottom rail 114, and/or any other desired position based on the strength of magnet 216, the shape and contour of bottom rail 114 and mounting element 214, whether other biasing elements 206 are used, etc. Biasing element 206 can provide a biasing force to mounting element 214 to position handle member 202 in close proximity or direct contact with bottom rail 114 when handle structure 200 is not in use. In addition, it is understood that flexible member 212 can be modified, adapted, etc., to include handle 208 or similar devices (e.g., a loop or ring), fixtures, etc., to improve ease of use. It is also understood that flexible member 212 and/or magnet 216 can be substituted and/or used with other embodiments of handle structure 200 described herein.

Figure 7:
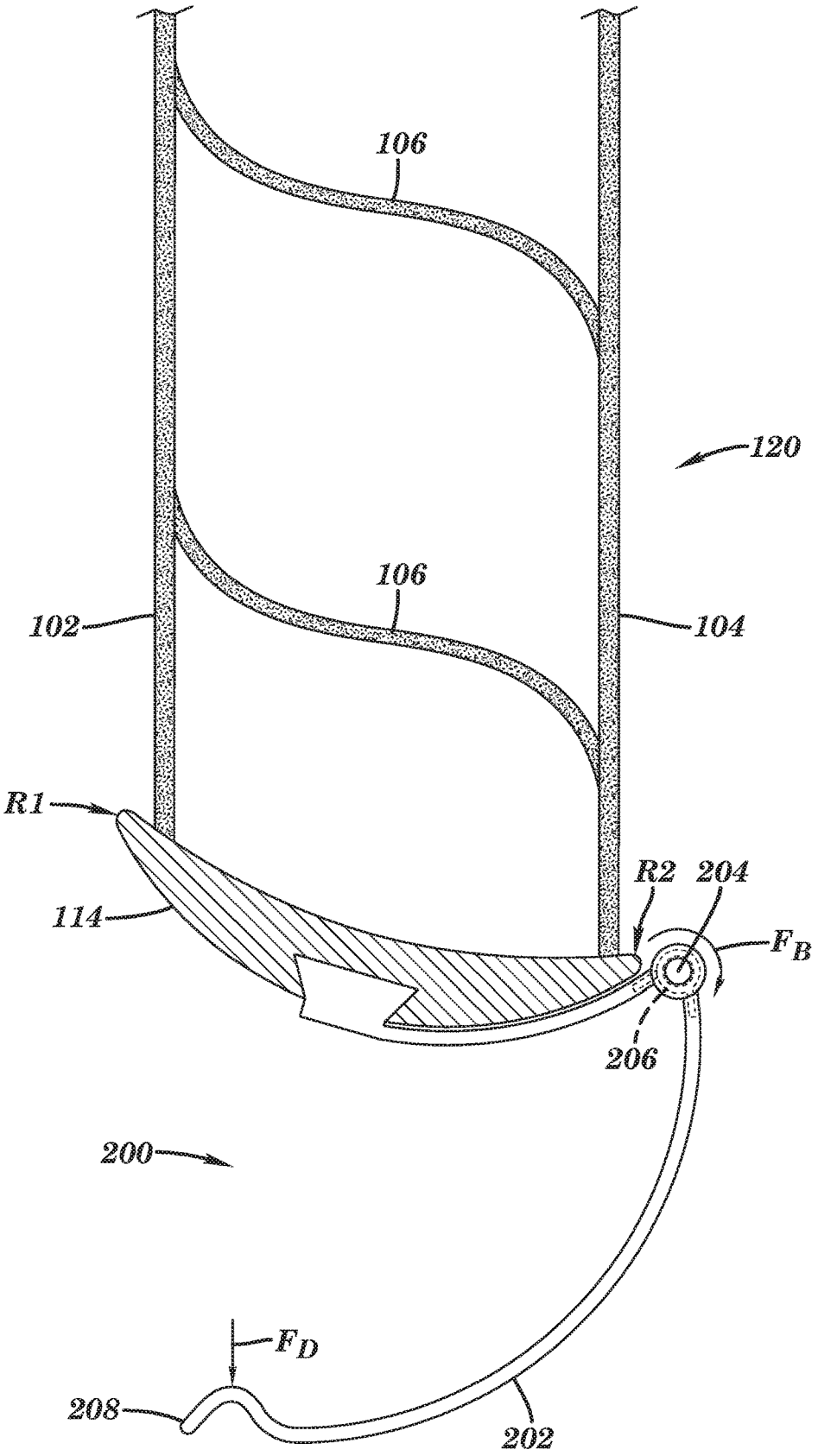
FIG. 7 shows a side view of a handle structure of a window shading assembly with a downward force being applied thereto according to embodiments of the present disclosure.

Turning to FIG. 7, handle structure 200 being operated in embodiments of the present disclosure is shown. An externally applied downward force $F_D$ applied to handle member 202 (e.g., through handle 208) can counteract and temporarily overcome biasing force FB such that handle member 202 pivots about pivot coupling 204. The rotation of handle member 202 about pivot coupling 204 can thus transfer downward force $F_D$ to rear facing 104 of window shading 120. The transferred downward force can move rear facing 104 downwardly together with or relative to front facing 102. In addition, as shown by example in FIG. 7, applying a downward force to handle structure 200 can direct the applied force along the plane of rear facing 104, thereby causing front facing 102 to slacken. This adjustment in the tension of window shading 120 can cause rear facing 104 to be positioned vertically lower than front facing 102 as a result of the application and directing of force substantially vertically along rear facing 104. As is also shown in FIG. 4, the application of downward force $F_D$ to rear facing 104 of window shading 120 can also rotate bottom rail 114 in response to the downward movement of rear facing 104.

Figure 8:
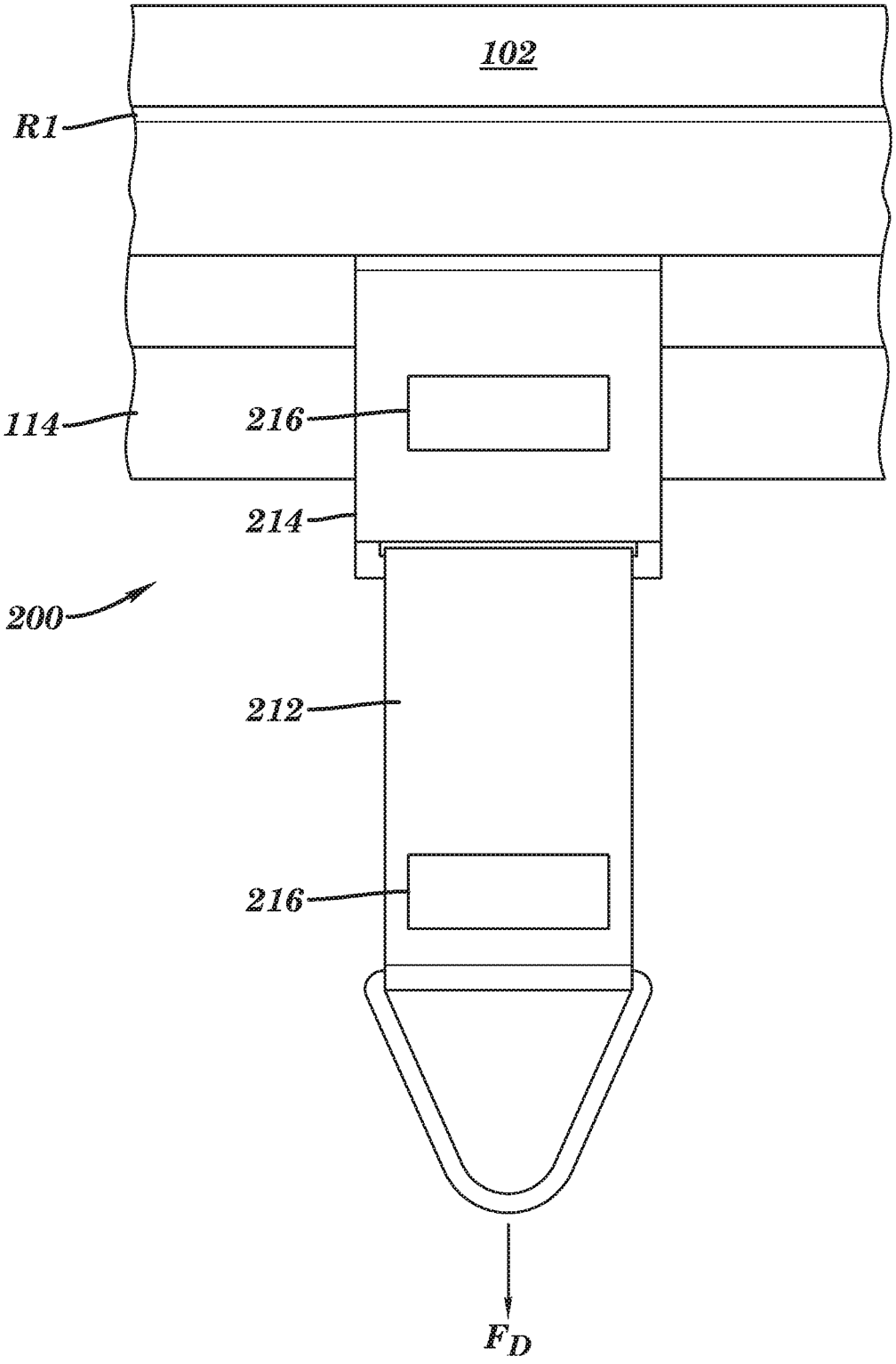
FIG. 8 shows a front view of an alternative handle structure being operated according to embodiments of the present disclosure.

Referring to FIG. 8, alternative embodiments of handle structure 200 can be operated in a similar manner to the previously described embodiments, e.g., those depicted in FIGS. 5 and 6. Externally applied downward forces $F_D$ can be applied to flexible member 212 can be partially offset by biasing force $F_B$ (FIG. 6) of magnet 216 or other biasing elements 206 (FIGS. 4, 7) such that force applied to handle member 202 through flexible member 212 moves rear facing 104 (FIGS. 1-4, 6-7) downward. A majority of downward force $F_D$ being applied in a direction coincident with the plane of rear facing 104 can move rear facing 104 downwardly together with or relative to front facing 102, as described elsewhere herein. The applied downward force $F_D$ can also rotate bottom rail 114 based on the amount of downward force applied to rear facing 104.

Figure 9:
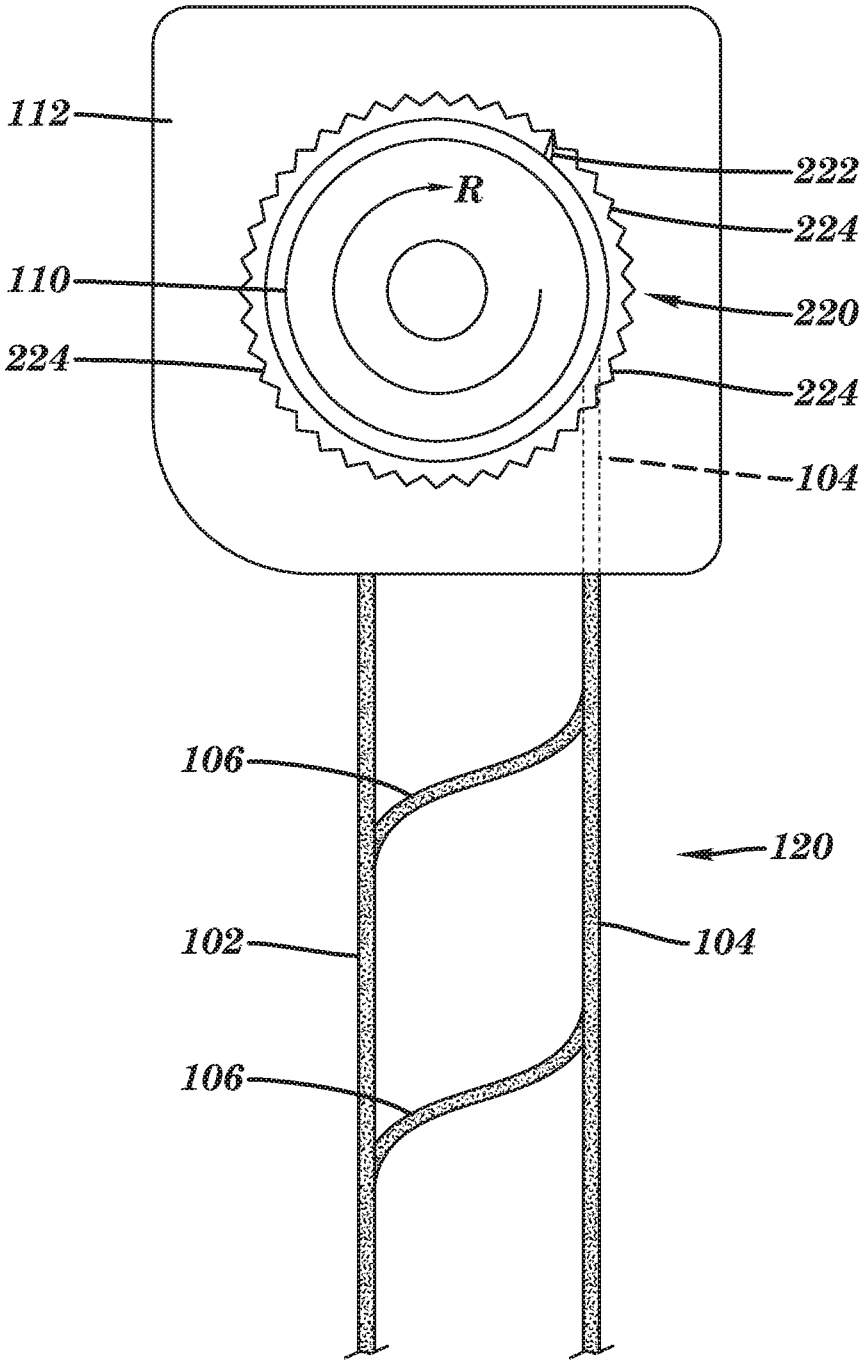
FIG. 9 shows a schematic cross-sectional, side view of a ratcheting mechanism of a headrail according to embodiments of the present disclosure.

Turning to FIG. 9, an illustrative ratcheting mechanism 220, which may be used to control operation of window shading 120 without the use of cords, is shown. It will be appreciated that ratcheting mechanism 220 is effectively coupled to handle structure 200 (FIGS. 3-4) through rear facing 104 of window shading 120. Ratcheting mechanism 220 can be positioned inside roller 110 to hold facings 102, 104 in any desired position of deployment, and to retract front and rear facings 102, 104 back onto roller 110. To improve the function and operability of roller 110, embodiments of the present disclosure also include optionally attaching facing(s) 102, 104 to roller 110 in positions where greater variability in light transmission through facings 102, 104 is possible. For instance, each facing 102, 104 can be attached to roller 110 at positions substantially horizontally aligned with each other and diametrically opposed on roller 110, when vanes 106 are in a substantially horizontal position and perpendicular to facings 102, 104 and bottom rail 114 is separated from roller 110 by a desired amount of displacement. A user can pull the rear of bottom rail 114 downward (e.g., through handle 208), past the normal maximum transparency condition (i.e., vanes substantially horizontal, maximum transparency of window shading 120), with another downward pull to set or release ratcheting mechanism 220 in roller 110. Pulling handle element 202 downward can rotate roller 110, e.g., along the direction of arrow R in FIG. 9, relative to ratcheting mechanism 220 to cause window shading 120 to extend from casing 112 to cover approximately the full length of a corresponding window height. It is understood that roller 110 and ratcheting mechanism 220 may be concentric or may have varying relative positions based on, e.g., the type of ratcheting mechanism 220 used. As shown in FIG. 9, ratcheting mechanism 220 can include a tang 222 configured for engaging one of a plurality of stops 224 spaced, e.g., no farther apart than the roller rotation angle associated with an over-draw length, to enable an over-pulling motion to set or release ratcheting mechanism 220. The spacing of stops 224 can also vary depending on the width of the vanes 106 and the size of roller 110. In a particular embodiment, ratcheting mechanism 220 can include multiple stops 224 within a single complete rotation, thereby allowing vanes 106 to be set at intermediate angles between fully open positions for facings 102, 104 (i.e., substantially transparent) and closed positions for facings 102, 104 (i.e., an opaque setting which approximates a flattened fabric). Although ratcheting mechanism 220 is shown by example as a rotatable element mechanically coupled to stops 224 through tang 222, it is understood that modified and/or alternative embodiments of ratcheting mechanism 220 (e.g., spring-loaded ratchets) may be used as is known in the art. Other example types of ratcheting mechanisms operable for use with embodiments of the present disclosure can include, e.g., those detailed in published U.S. patent application numbers US 2015/0047792 and US 2015/0059991.

Figure 10:
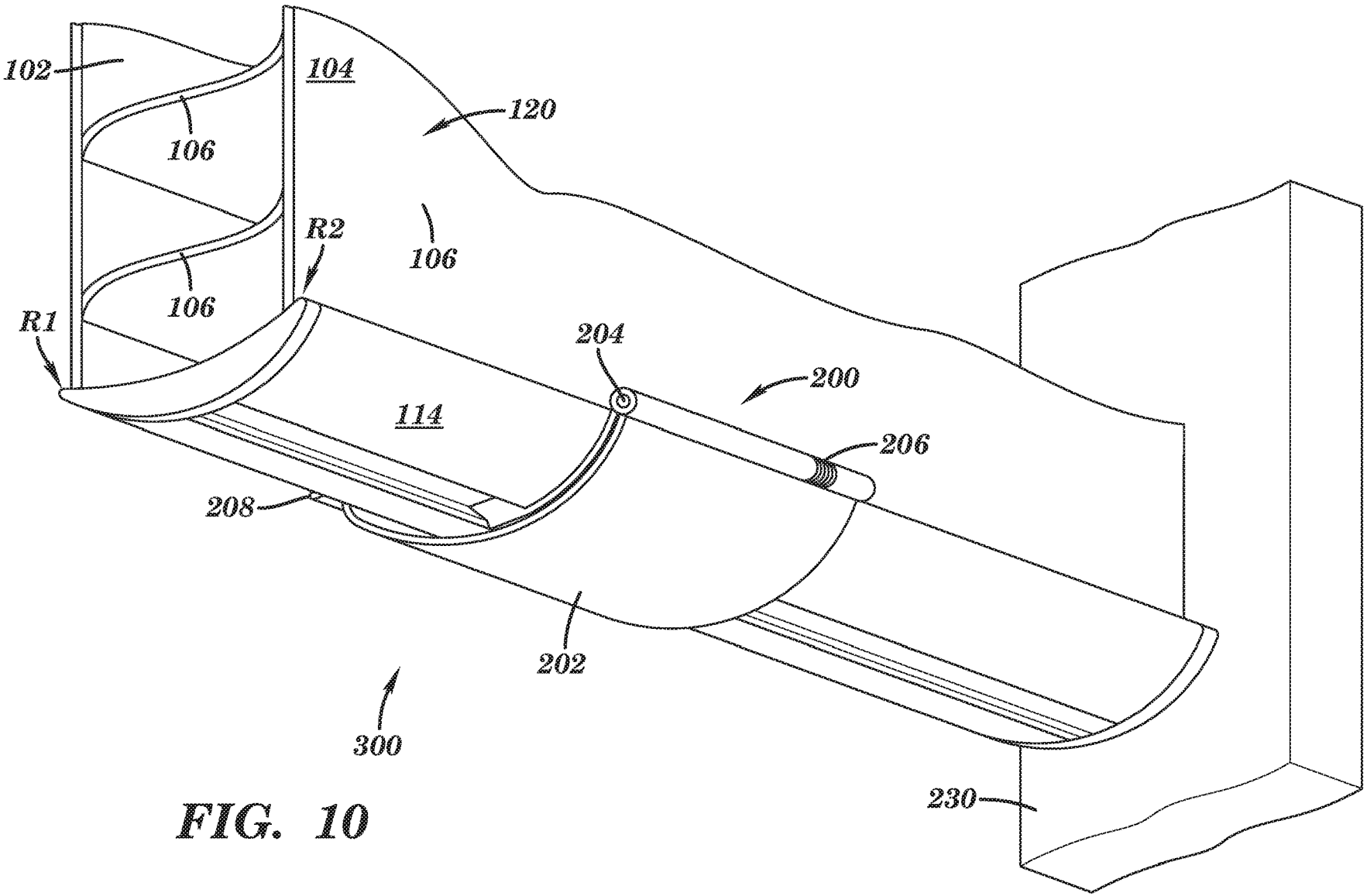
FIG. 10 shows a perspective view of a window shading assembly with a handle structure according to embodiments of the present disclosure.

Turning to FIG. 10, a window 230 is shown adjacent to a window shading assembly 300 incorporating window shading 120 and an embodiment of handle structure 200. Window shading assembly 300 can include window shading 120 embodied as a fabric venetian-type window shading, or can be modified for use with other types of window shadings 120. As demonstrated elsewhere herein, a window shading refers to a type of window covering which includes vanes 106 extending between facings 102, 104. Vanes 106 can be composed of, e.g., wood, plastic, a fabric, a composite material, or any other currently known or later developed type of shading material (whether substantially transparent, translucent, or opaque). Window shading assembly 300 can thereby include front facing 102 and opposing rear facing 104 coupled by vanes 106 positioned therebetween. As shown by example in FIG. 8, front and rear facings 102, 104 can be oriented in a substantially transparent (i.e., high light transmission) position, with vanes 106 being substantially perpendicular therewith to join front and rear facings 102, 104 to each other. In the example of FIG. 10, vanes 106 are positioned substantially perpendicular to window 230 in an "open" position. Embodiments of handle structure 200 can provide for adjusting the position of front and rear facings 102, 104, e.g., by moving front and/or rear facings 102, 104 relative to each other to transmit or substantially prevent the passage of light from window 230 through window shading assembly 300. More particularly, referring to FIGS. 7, and 9-11, a downward force can be applied to handle member 202, e.g., at handle 208, to rotate handle structure 200 about pivot coupling 204. Tang 222 of ratcheting mechanism 220 can progress through one or more stops 224 as window shading 120 is pulled from roller 110 until the withdrawn length of window shading 120 reaches or exceeds a setting length. At this point, tang 222 can be set in one stop 224 of ratcheting mechanism 220, thereby holding the withdrawn window shading 120 in place. Through the setting of ratcheting mechanism 220, window shading 120 can remain in place after being withdrawn from roller 110 as shown in FIG. 10, after handle member 202 returns to its biased position. The position of stops 224 can be chosen to cause at least one stop 224 of ratcheting mechanism 220 to be positioned between two complete rotations of roller 110. Tang 222 of ratcheting element 220 can also release from a holding position (also known as a "catch") of ratcheting element 220 when moved by a predetermined distance after being set (i.e., over-draw), by inclusion of a spring and/or other conventional biasing components known in the art. Window assembly 300 can therefore allow window shading 120 to be retracted or rolled onto roller 110 without the use of a cord-type mechanism (e.g., cord 118 of FIGS. 1-3), e.g., by causing a spring or other conventional catch-and-release mechanism to release tang 222 of ratcheting mechanism 220. Releasing tang 222 of ratcheting mechanism 220 can cause tang 220 and roller 110 to retract through previous stops 124 until reaching an initial or desired position. The movement of roller 110 can also retract window shading 120 onto roller 110 and/or cause front and rear facings 102, 104 to revert to a substantially opaque position (i.e., a reduced or minimized light transmission level).

Figure 11:
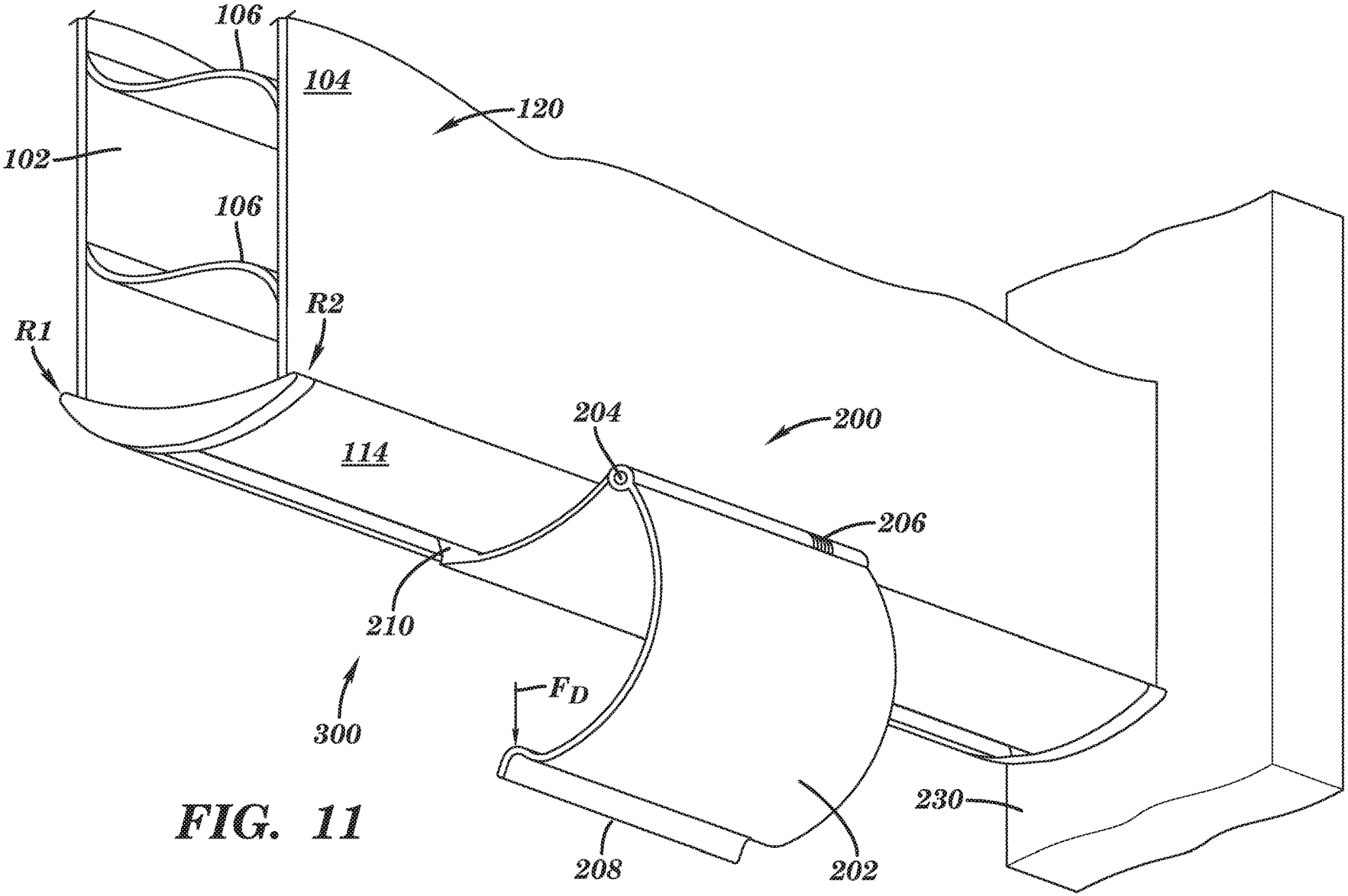
FIG. 11 shows a perspective view of a window shading assembly and handle structure with a downward force applied thereto according to embodiments of the present disclosure.

A mostly transparent position of window shading assembly 300 is shown in FIG. 10, and window shading assembly 300 is shown in FIG. 11 as handle member 202 is pulled downward. Applying a force to handle member 202 can unroll or extend window shading 120 from being almost entirely rolled about roller 110, into a deployed or partially deployed or extended position in which window shading 120 is unrolled or extended from roller 110. After window shading 120 is extended, vanes 106 can be oriented to extend along front and rear facings 102, 104 to block viewing between vanes 106 such that window shading 120 is substantially opaque or translucent. A user can apply a downward force to handle member 202 to actuate ratcheting mechanism 220 of roller 110. Pulling rear facing 104 can also pull tang 222 of ratcheting mechanism 220 to a particular stop 224 to move rear facing 104 into a lower position in closer horizontal alignment with front facing 102. The closer horizontal alignment can cause vanes 208 to be increasingly transverse to (closer to substantially perpendicular to) the planes of front and rear facings 102, 104 such that window shading assembly 300 is substantially translucent or transparent with respect to light passing therethrough.

Applying a downward force to handle member 202 after vanes 106 are opened can cause tang 222 to reach a release position of ratcheting mechanism 220, thereby pulling window shading 120 back onto roller 110. The release position may correspond to, e.g., a lower end of rear facing 104 being unrolled to a position below front facing 102 (over-draw). Thus, using handle structure 200 to pull rear facing 104 can perform different functions when window shading 120 is extended from roller 110. For example, pulling rear facing 104 via handle structure 200 can retract window shading 120 onto roller 110, and/or adjust the orientation of vanes 106 by moving tang 222 through intermediate stops 224, such that window shading 120 either substantially transmits or blocks light.

In an embodiment, rear facing 104 can be oriented to face window 230, and front facing 102 can be oriented to face internally (i.e., into a room or particular space). Other embodiments of the present disclosure can relate to handle structure 200 as coupled to window shading assembly 300 with window shading 120. As discussed herein, ratcheting mechanism 220 can be coupled to handle structure 200 through rear facing 104, with rear facing 104 being attached to roller 110 by being rolled thereon. As a result, ratcheting mechanism 220 can be operable to position window shading 120 in any one of the several positions discussed herein (e.g., retracted positions, partially deployed non-transparent positions, a fully deployed non-transparent position, and/or fully deployed, partially transparent positions, etc.).

Figure 12:
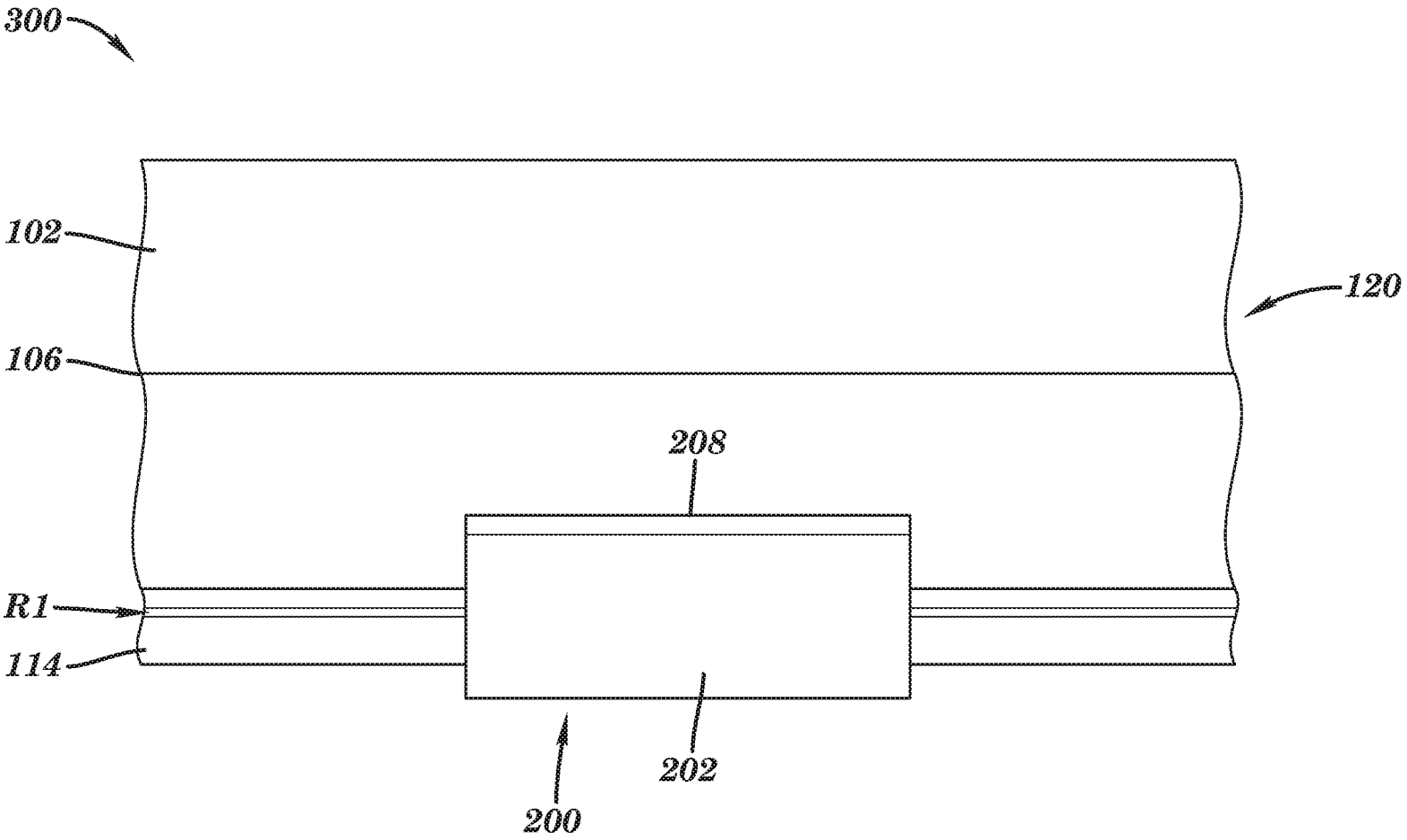
FIG. 12 shows a front perspective view of a window shading assembly and handle structure according to embodiments of the present disclosure.

Referring to FIG. 12, an embodiment of window shading assembly 300 with handle 208 protruding from bottom rail 114 is shown. In FIG. 12, vanes 106 are shown to be in a substantially opaque position and with only front facing 102 being visible. When handle member 202 is not subject to a downward force, handle member 202 can be proximal to bottom rail 114, giving the appearance of being part of bottom rail 114. Handle 208 can thereby protrude outward from bottom rail 114 to provide the appearance of a simple handle-actuated assembly. Despite this appearance, handle member 202 can be engaged to continue to redistribute downward forces applied thereto to rear facing 104 positioned laterally behind front facing 102. It will be appreciated that the coupling of handle member 202 to the rear side of bottom rail 114 directs and focuses force applied to handle member 202, such as to handle 208, to rear facing 104 more effectively than if downward force were applied manually to bottom rail 114 as a whole (generally not at a focused point along the bottom rail 114).

In addition to the various structures described herein and illustrated, e.g., in FIGS. 4-12, embodiments of the present disclosure also provide methods of operating window shade assembly, e.g., by applying embodiments of handle structure 200. A method according to the present disclosure can include applying a downward force at a point vertically aligned with the plane of front facing 102, e.g., directly to a free end of handle member 202, an instrument such as handle 208, and/or any other currently known or later developed instrument for receiving and/or directing an externally imparted force. Responsive to the applied force, handle member 202 of handle structure 200 can pivot about pivot coupling 204 and against a biasing force applied by biasing element 206. The rotation of handle member 202 about pivot coupling 204 can thereby redirect the applied force to rear facing 104 of window shading 120.

As discussed elsewhere herein, this redirecting of applied force can slacken front facing 102 and move rear facing 104 of window shading 120 downward to actuate ratcheting mechanism 220. As a result, handle structure 200 during operation can convert a downward force applied by a user along the planar orientation of front facing 102 into a downward force applied along the planar orientation of rear facing 104. In additional or alternative embodiments, handle structure 200 may be coupled to window shading 102 such that handle member 202 couples to a point laterally behind rear facing 104 relative to front facing 102 (e.g., behind rear facing 104). For example, rear facing 104 may couple to bottom rail 114 at a selected position, and bottom rail 114 may extend beyond rear facing 104. Handle member 202 may pivotally couple to bottom rail 114 at the rearwardmost point of the extent extending rearwardly beyond rear facing 104, creating an offset between a plane of rear facing 104 and a plane in which downward force is applied to bottom rail 114. In this case, the downward force applied to handle structure 200 can be redirected to a vertical direction parallel to but positioned behind rear facing 104. For some window shadings 120, this positioning of handle structure 200 relative to rear facing 104 can reduce the amount of downward force for actuating facings 102, 104 and ratcheting mechanism 220.

Embodiments of the structures and methods described herein can offer some commercial and technical advantages, several of which are discussed herein. For example, as detailed in Published Application US 2015/0047792, applying a downward force to rear facing 104 of window shading 120 can reduce the amount of force needed to adjust a position and light transmission level of front and rear facings 102, 104. For example, a force of approximately seven pounds may be needed to downwardly move a front facing of a conventional window shading 120. However, applying a downward force directly to rear facing 104 may reduce the amount of force to approximately four pounds, thereby providing greater ease of use and adjustability for a user of window shading 120. In still other alternative embodiments, redirecting the amount of downward force along a plane positioned behind rear facing 104 can further reduce the amount of applied force, e.g., to approximately three pounds. As a result, handle structure 200 can provide an intuitive mechanism for reducing the amount of force needed to adjust and/or operate window shading 120. Methods according to the present disclosure, in addition, can generally allow a user to impart a force in one plane to yield an applied force within a different plane, parallel to but distal to the plane where force is initially applied.

Embodiments of the disclosure can include alternative structures and configurations. It is therefore understood that the various additional and/or alternative embodiments according to the present disclosure can be implemented together or separately, and/or with elements and sub-elements thereof being used together or separately as discussed herein. Thus, further embodiments of the disclosure include a handle coupled to an architectural covering to provide one or more enhanced methods of extending or retracting the covering across an architectural structure. In one embodiment, the handle is coupled to a portion of the covering, such as a movable rail, in a manner that permits operation of the covering via the handle, such as by a user applying force via the handle to a part of the covering spaced apart from the shade material, which may be attached to the movable rail. The handle may be associated with a cordless covering in some contexts. In such embodiments, the cordless covering may be operated by a user manipulating the handle to move the movable rail. The user may manipulate the handle to move the rail without touching a shade material (such as a fabric) coupled with the rail, thereby not damaging the aesthetics of the shade material. The handle may conform to the configuration of the element to which it is coupled, such as the movable rail, to provide a desired aesthetic and/or functional characteristic, such as providing a clean or streamlined appearance when coupled to the covering. The handle may be coupled with the movable rail between front and rear edges of the rail. The handle may be positionable anywhere along a length of the rail. The handle may include a pivotable handle member that swings away from the movable rail, and the handle member may be biased towards the movable rail to provide a smooth, "clean," or streamlined appearance when not in use.

Figures 15, 16:
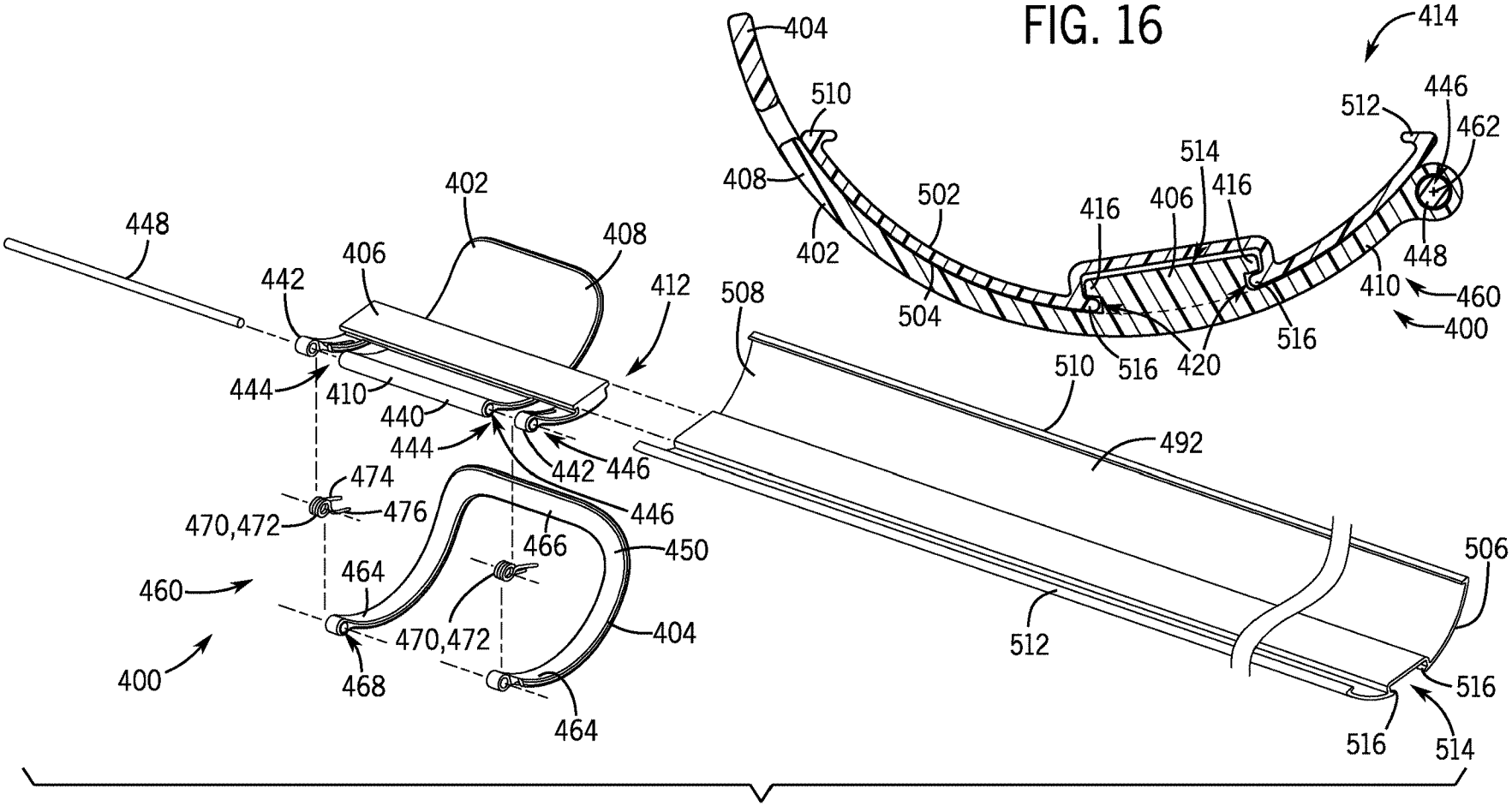
FIG. 15 shows a fragmentary, exploded view of the covering of FIG. 13 in accordance with an embodiment of the present disclosure.
FIG. 16 shows an enlarged, cross-sectional view of a handle assembly taken along line A-A of FIG. 13 in accordance with an embodiment of the present disclosure.
Figure 17:
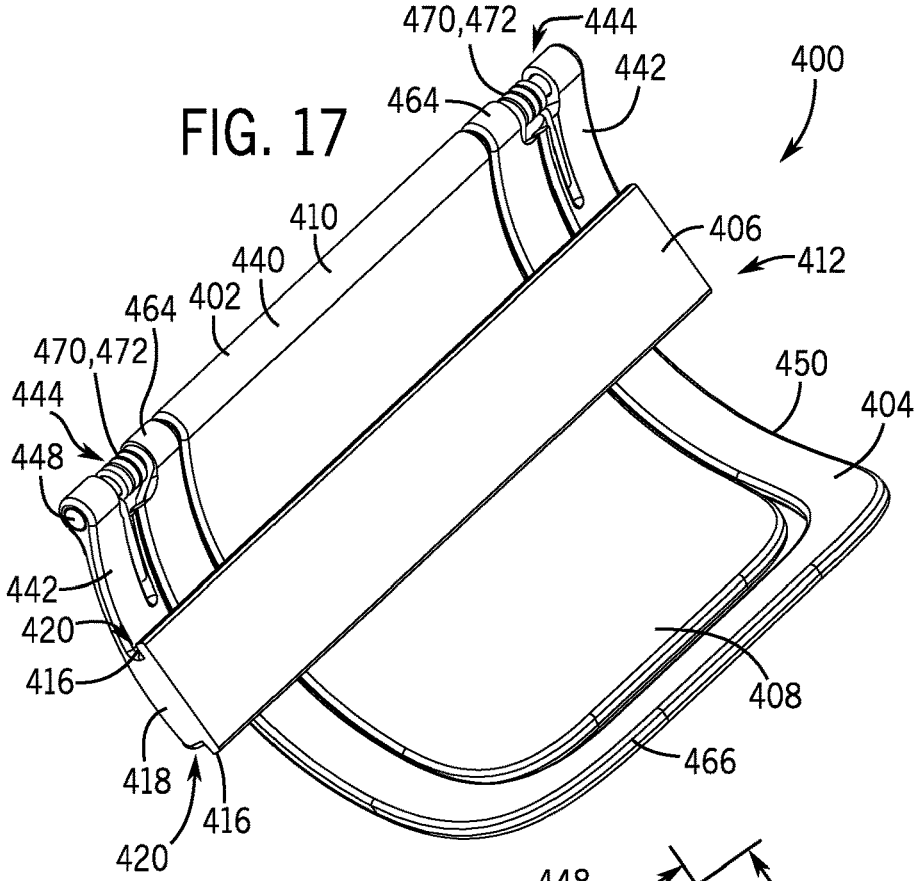
FIG. 17 shows a top perspective view of a handle assembly in accordance with an embodiment of the present disclosure.
Figure 18:
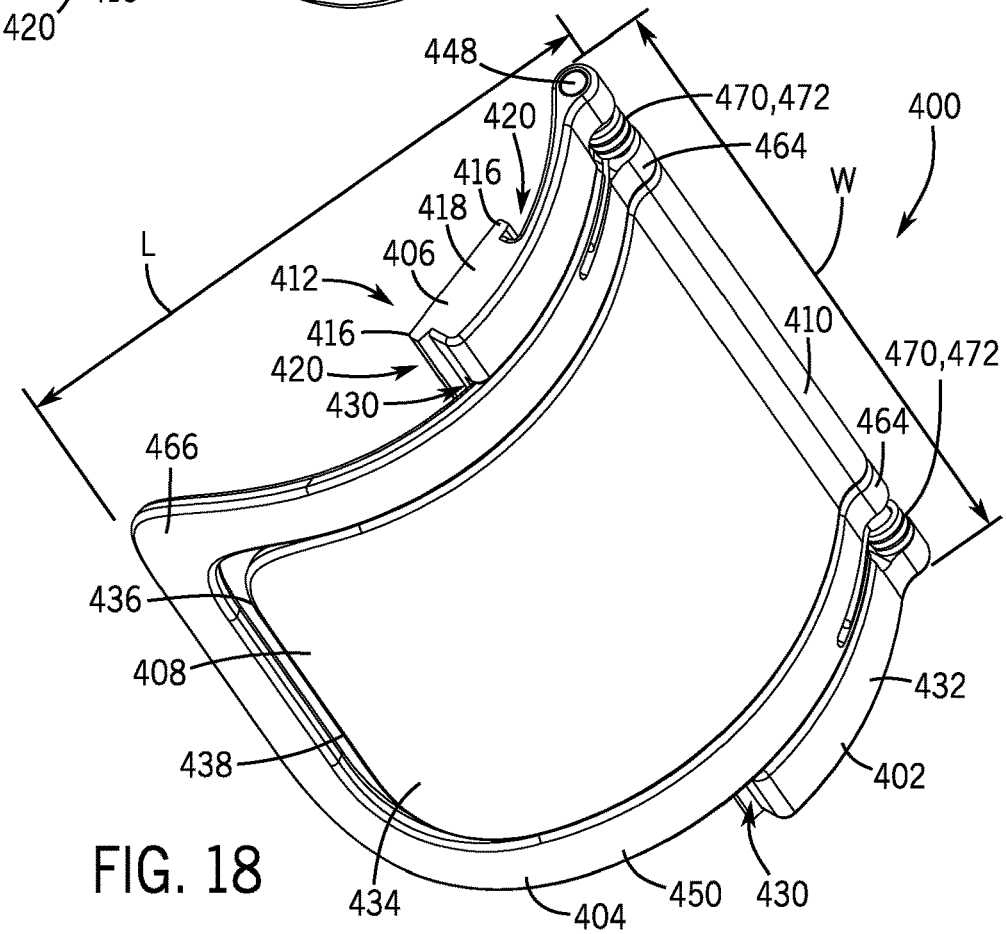
FIG. 18 shows a bottom perspective view of the handle assembly of FIG. 17 in accordance with an embodiment of the present disclosure.

Referring to FIGS. 13-21, a handle assembly 400 according to one embodiment of the present disclosure includes first and second members 402, 404 connected together to collectively define a length L (see FIG. 18), a transverse width W (see FIG. 18), and a thickness T (see FIG. 20) of handle assembly 400 such that handle assembly 400 may be considered wide and thin. The first member 402, which may be referred to as a base member, a fixed member, or any combination thereof, may include an attachment portion 406 and opposing front and rear portions 408, 410 extending laterally from opposing sides of attachment portion 406. In one embodiment, attachment portion 406 may extend substantially along the width W of handle assembly 400, with front and rear portions 408, 410 extending laterally therefrom substantially along the length L (see FIG. 18). As more fully explained below, the attachment portion 406 may include an attachment structure 412 operable to couple, for instance, first member 402 to an associated covering 414 for an architectural structure, such as a window, doorway, archway, or the like (see FIGS. 13 and 14), to permit a user to operate the covering 414. For example without limitation, with reference to FIGS. 17 and 18, attachment structure 412 may include opposing tabs 416 extending laterally from a central portion 418 of attachment portion 406. Tabs 416 may extend longitudinally along the length of attachment portion 406 or, in some embodiments, may be intermittently connected to central portion 418. In such embodiments, attachment portion 406 may be substantially T-shaped in cross-section to facilitate attachment of first member 402 to covering 414, as detailed below. In one embodiment, front and rear portions 408, 410 of first member 402 may extend from attachment portion 406 at a spaced distance below the opposing tabs 416. In this manner, opposing grooves 420 may be defined between the opposing tabs 416 and the respective front and rear portions 408, 410 for connection with the covering 414, as explained more fully below (see FIG. 21). Grooves 420 can thus be shaped to matingly engage a corresponding portion of covering 414 and/or other external structures, providing a structural connection to handle assembly 400. As best seen in FIG. 18, a plurality of channels 430 may be defined in an exterior surface (e.g., a bottom surface 432) of the attachment portion 406 to receive one or more pivotable elements, couplings, etc., therein. Channels 430 may extend transversely to the attachment portion 406, such as substantially along the length L of the handle assembly 400.

With continued reference to FIG. 18, front portion 408 of first member 402 may define a touch point or gripping feature 434 for a user and may be curvilinear in shape. For example, front portion 408 may be defined in part by a front edge 436 extending (e.g., looping) from the attachment portion 406. Front edge 436 may be curved such that a middle portion 438 of front edge 436 is spaced furthest from attachment portion 406. As illustrated, front edge 436 may extend from the attachment portion 406 at a distance spaced away (inward) from the periphery of attachment portion 406 defining the width W of the handle assembly 400. In this manner, front portion 408 may include a width WFP that is smaller than the width W of the handle assembly 400 such that the second member 404 may be positioned within the width W of handle assembly 400, as explained in detail below (see FIG. 19). As illustrated, front edge 436 may extend from the attachment portion 406 at a substantially transverse angle, though other extension angles, such as less than 90 degrees or greater than 90 degrees, are contemplated without departing from the spirit and scope of the present disclosure.

Figure 19:
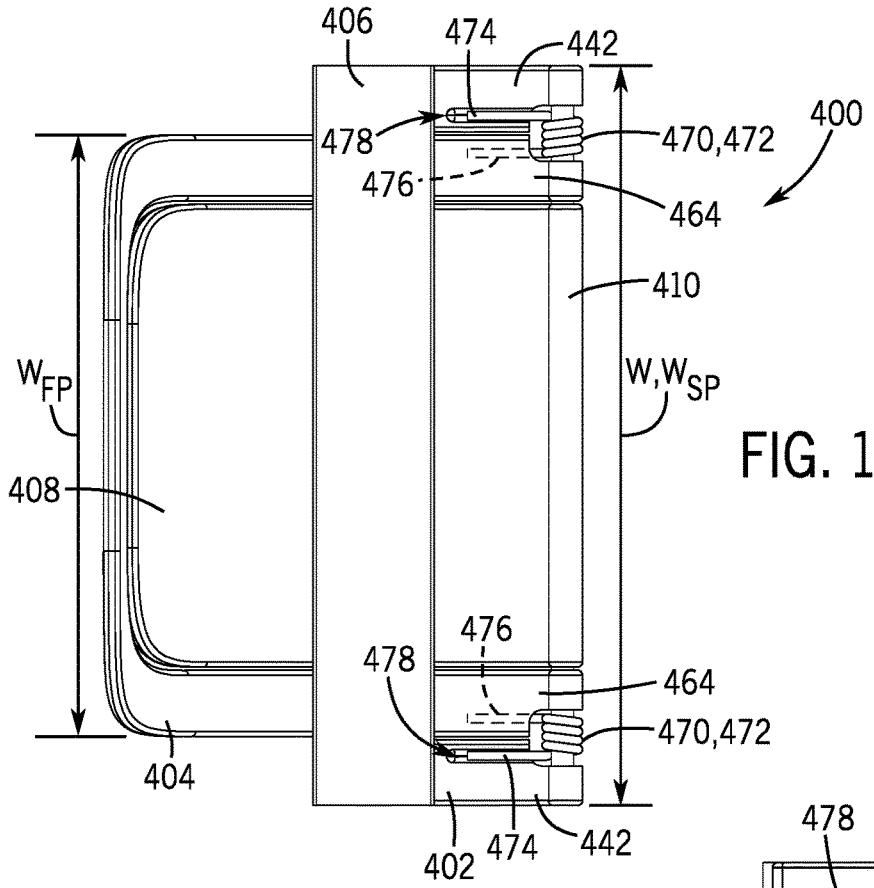
FIG. 19 shows a top view of the handle assembly of FIG. 17 in accordance with an embodiment of the present disclosure.
Figure 20:
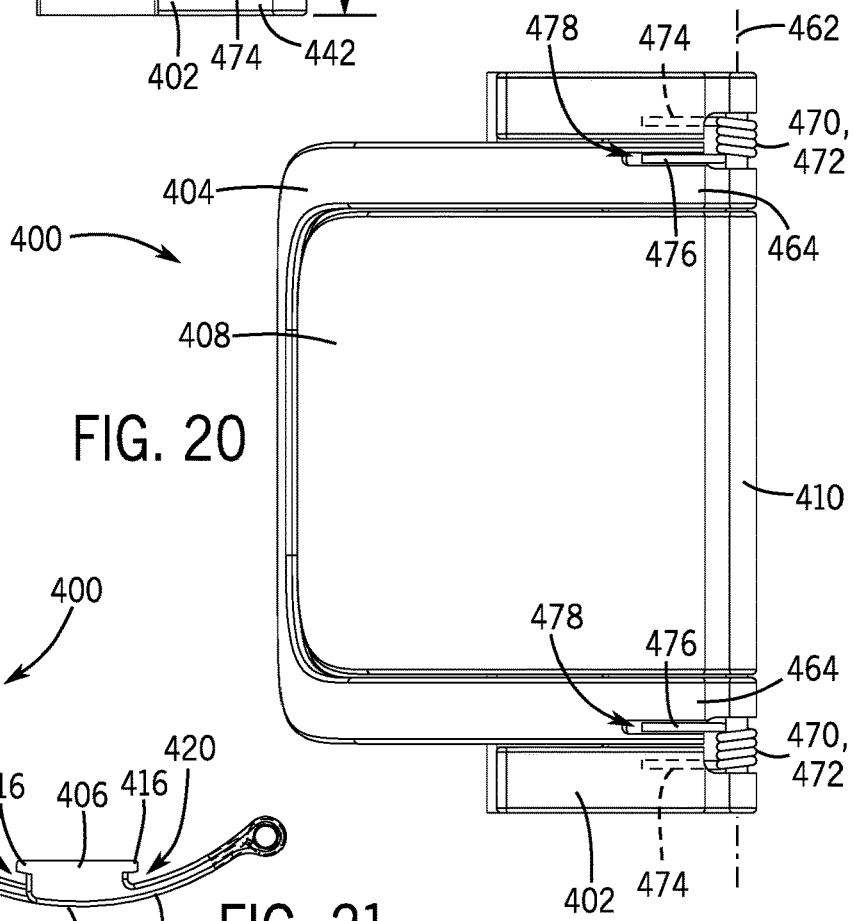
FIG. 20 shows a bottom view of the handle assembly of FIG. 17 in accordance with an embodiment of the present disclosure.
Figure 21:
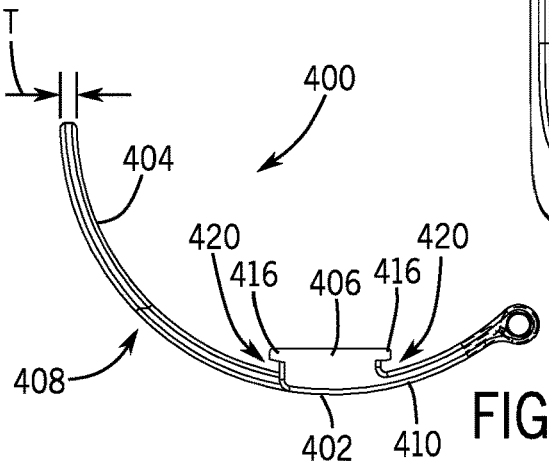
FIG. 21 shows a side elevation view of the handle assembly of FIG. 17 in accordance with an embodiment of the present disclosure.

First member 402 may be arranged to permit second member 404 to pivot relative to first member 402. In one embodiment, illustrated in FIG. 17, rear portion 410 of first member 402 may be defined by a center portion 440 and at least one side portion 442 positioned on each side of center portion 440. In one embodiment, each side portion 442 may be spaced laterally from the center portion 440 to define openings 444 therebetween. As explained below, openings 444 may be sized and shaped to receive at least a portion of the second member 404 therein. As shown in FIG. 19, side portions 442 may be positioned outboard the front portion 408 along the width W of the handle assembly 400 such that a width $W_{SP}$ defined between side portions 442 may be greater than the width $W_{FP}$ of the front portion 408. In some embodiments, the rear portion 410 may include structure operable to couple first and second members 402, 404 together. For example, as best seen in FIG. 15, in one embodiment, rear portion 410 may define at least one bore 446 to facilitate coupling of the second member 404 to first member 402, as explained below. As illustrated, aligned bores 446 may be defined in center portion 440 and side portions 442 for the purposes explained hereinafter. Though shown and described as including a center portion 440 and at least one side portion 442, first member 402 may include any suitable configuration operable to pivotably couple first member 402 to second member 404. For example without limitation, first member 402 may be configured such that second member 404 is completely outside first member 402, or vice-versa.

With reference to FIG. 16, front and rear portions 408, 410 of first member 402 may be sized and shaped to achieve a desired aesthetic and/or functional characteristic. In some embodiments, front and rear portions 408, 410 may follow the contour and/or shape of a portion of covering 414 to which it is attached. For example, front portion 408 and/or rear portion 410 may be curved in transverse cross-section to create a smooth, clean, or non-obtrusive transition between front portion 408 and/or rear portion 410 of handle assembly 400 and associated covering 414. Additionally or alternatively, depending on the particular application, front and rear portions 408, 410 may be smooth to provide a desired aesthetic characteristic and/or increase a user's comfort in grasping first member 402 specifically or handle assembly 400 in general.

Referring now to FIGS. 17 and 18, second member 404 may be attached or otherwise coupled to rear portion 410 of first member 402. In some embodiments, second member 404, which may be referred to as a handle member or a movable member, may be rotatably coupled to first member 402 by an elongate shaft 448. In such embodiments, second member 404 may include a handle portion 450 extending from shaft 448. Shaft 448 may be cylindrical and may include a circular or non-circular cross-section. As best seen in FIGS. 15 and 16, shaft 448 is sized and shaped for rotatable receipt within at least one bore 446 defined in the rear portion 410 of first member 402. Together, shaft 448 and bore 446 define a hinge assembly 460 by which second member 404 may be pivoted relative first member 402 about a hinge centerline 462 and between stored and use positions, as explained hereafter. For example, in a stored position, the second member 404 may be positioned adjacent first member 402 such that the second member 404 is substantially flush with first member 402 (see FIG. 22). In a use position, second member 404 may be pivoted away from first member 402 such that first and second members 402, 404 extend at an angle relative to each other (see FIG. 23).

Referring now to FIG. 15, handle portion 150 may be substantially U-shaped and may include terminal end portions 464 and a grip portion or touch point 466 positioned therebetween. In some embodiments, touch point 466 may be an additional member connected to handle portion 450. Shaft 448 may be connected to terminal end portions 464. For instance, terminal end portions 464 may define bores 468 therethrough through which shaft 448 may be inserted. In some embodiments, shaft 448 may be formed monolithically with terminal end portions 464 as one integral piece. Referring to FIG. 17, when second member 404 is coupled to first member 402, such as via rotatable receipt of shaft 448 within bore(s) 446 of the rear portion 410, the terminal end portions 464 may be received within openings 444 defined between the center and side portions 440, 442 of first member 402. Additionally or alternatively, at least a portion of second member 404 (e.g., terminal end portions 464 and/or touch point 466) may be received within channels 430 defined in bottom surface 432 of attachment portion 406 at least when second member 404 is in a stored position (see FIG. 18). As illustrated, touch point 466 may compliment the size and shape of first member 402. For example, touch point 466 may be sized and shaped to closely match the curved nature of front edge 436 of front portion 408 to provide a smooth or clean interface or transition between first and second members 402, 404, for instance. Additionally or alternatively, touch point 466 may conform to the configuration of the element to which it is coupled, such as a movable rail, to provide a desired aesthetic and/or functional characteristic, such as providing a clean or streamlined appearance when coupled to covering 414.

Referring now to FIGS. 17-20, handle assembly 400 may include a biasing member 470 operable to bias second member 404 to a desired position relative to first member 402. For example, biasing member 470 may provide a biasing force directing second member 404 towards first member 402. In some embodiments, biasing force may be variable to provide an increasing amount of biasing effect with distance of second member 404 away from first member 402. The biasing force may be sufficient to maintain second member 404 adjacent first member 402 (e.g., in abutting relationship) under static conditions, such as by sufficiently counteracting the effect of gravity tending to rotate second member 404 away from first member 402. Biasing member 470 may be positioned at least partially between the first and second members 402, 404 and may bias the second member 404 to the stored position. In one embodiment, biasing member 470 may be a spring 472 (e.g., a helical torsion spring, leaf spring, etc., as discussed herein) having first and second ends 474, 476 engaged with the first and second members 402, 404, respectively (see FIGS. 19 and 20). In alternative embodiments, as also discussed herein, biasing member 470 can include and/or be provided as a torsion bar, a resinous material, a magnetic assembly, and/or any other currently known or later-developed mechanical biasing component. In the case of a spring, each of first and second members 402, 404 may define spring seats 478 therein operable to engage a corresponding first end 474 or second end 476 of spring 472. Spring seat 478 of first member 402 may be defined in at least one of side portions 442, and spring seat 478 of second member 404 may be defined in at least one of the terminal end portions 464. Spring seats 478 may be operable to twist, bend, extend, compress, or otherwise increase or decrease the spring force of the spring 472 during rotation of the second member 404 relative to the first member 402. In embodiments wherein spring 472 is a helical torsion spring, spring 472 may be rotatably mounted to shaft 448 and may be positioned at least partially in openings 444. Though described herein with reference to spring 472, the various components included within and/or connected to biasing member 470 may themselves be embodied as a torsion bar, a magnetic assembly, a resinous material, and/or any other suitable biasing mechanism or subcomponent thereof.

With reference to FIGS. 13-16, handle assembly 400 may be coupled to a portion of covering 414 to facilitate movement of covering 414 between extended and retracted positions covering or uncovering the architectural structure. For purposes of illustration, covering 414 may substantially take the form of the shade disclosed in U.S. Publication No. 2014/0216666 A1 to Smith et al, which is hereby incorporated herein in its entirety. In one embodiment, covering 414 may include a head rail 490, a movable rail 492 to which handle assembly 400 is attached, and a shade material 494 extending between head rail 490 and movable rail 492. Movement of covering 414 may be controlled by an operating system 496, such as the operating system disclosed in U.S. Publication No. 2014/0216666 A1. Shade material 494 may be substantially any type of shade, such as the shade material disclosed in U.S. Publication No. 2014/0216666 A1, and may include operable vanes 498 movable between open (see FIG. 13) and closed (see FIG. 14) orientations. To move vanes 498 between open and closed orientations, the covering 414 may include a vane orientation mechanism 500, such as the vane orientation mechanism disclosed in U.S. Publication No. 2014/0216666 A1.

The handle assembly 400 may be coupled with movable rail 492 between front and rear edges of the rail 492 and may conform to the shape and/or dimensions of an outer surface of the rail 492. The coupling of the handle assembly 400 to the rail 492 may allow positioning of handle assembly 400 anywhere along the movable rail 492. In one embodiment, illustrated in FIGS. 15 and 16, movable rail 492, which may be a bottom rail or a top rail, among others, may be an elongate member with a generally low aspect ratio of height to depth such that movable rail 492 may be considered long, thin, and deep. For example, in some embodiments, movable rail 492 may include an aspect ratio of height to depth between about 1:2 and about 1:5 (e.g., about 1:3.5). As illustrated, movable rail 492 includes a top surface 502 and a bottom surface 504. Movable rail 492 includes opposing left and right side edges 506, 508 and opposing front and rear longitudinal edges 510, 512 together forming a perimeter of movable rail 492. To couple handle assembly 400 to movable rail 492, movable rail 492 may include a longitudinal channel 514 defined in a portion (e.g., bottom surface 504) of movable rail 492. In some embodiments, channel 514 may be positioned nearer one of front and rear longitudinal edges 510, 512 (e.g., nearer the rear longitudinal edge 512), though channel 514 may be positioned substantially midway between the front and rear longitudinal edges 510, 512 depending on the particular application. Channel 514 may be sized and shaped to allow coupling of attachment portion 506 therein. In this manner, handle assembly 400 may be at least partially received within channel 514 to couple handle assembly 400 to movable rail 492. For example, opposing flanges 516 may extend within channel 514 along a length (e.g., the entire length) of movable rail 492 between the left and right side edges 506, 508. As best seen in FIG. 16, flanges 516 may extend inwardly towards each other and may be sized and shaped for receipt within grooves 420 defined in attachment portion 406. In such embodiments, the outwardly extending tabs 416 of the handle assembly 400 and inwardly extending flanges 516 of movable rail 492 may be complementary hooks engaging each other.

Figure 13:
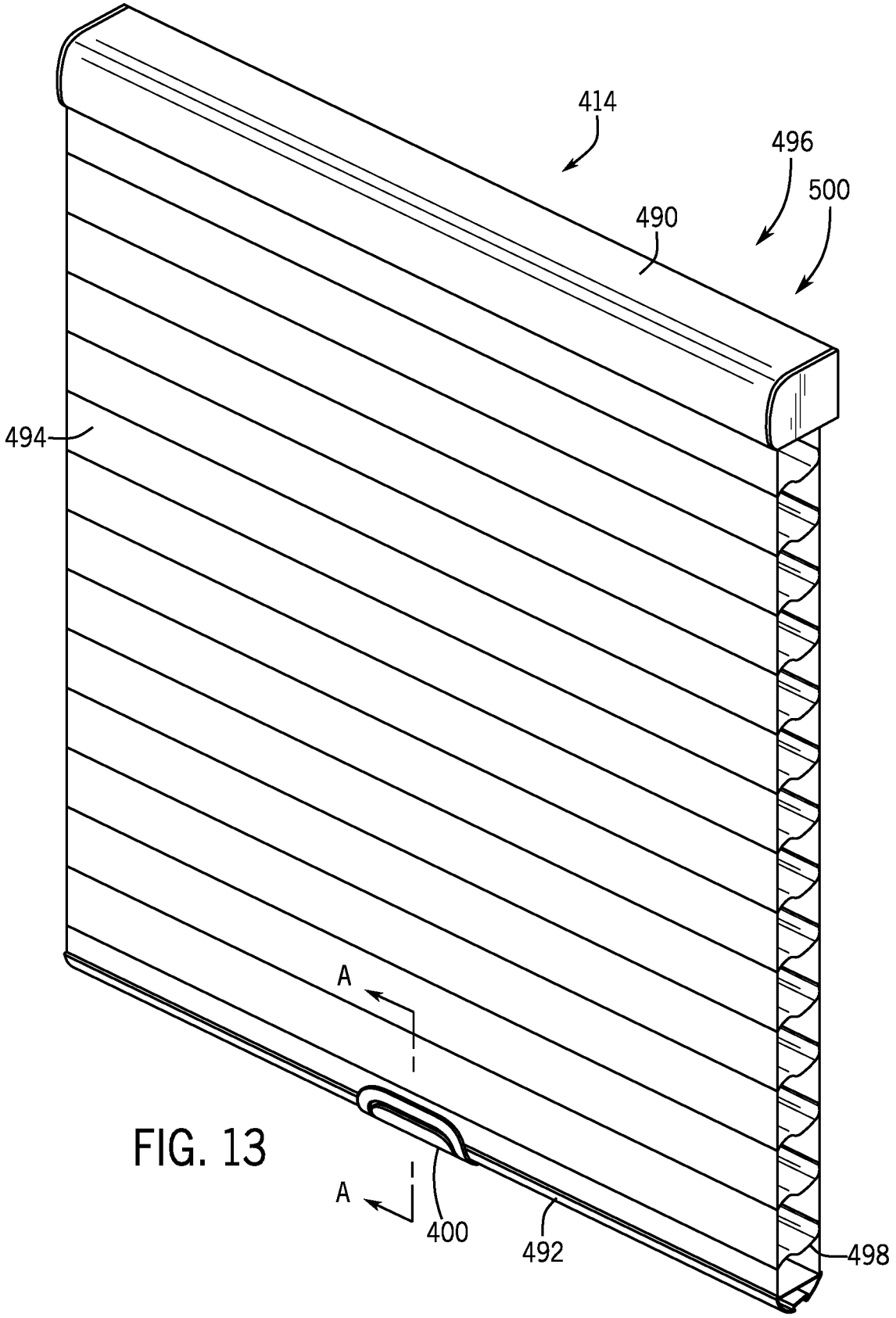
FIG. 13 shows a front perspective view of a covering in an open configuration in accordance with an embodiment of the present disclosure.
Figure 14:
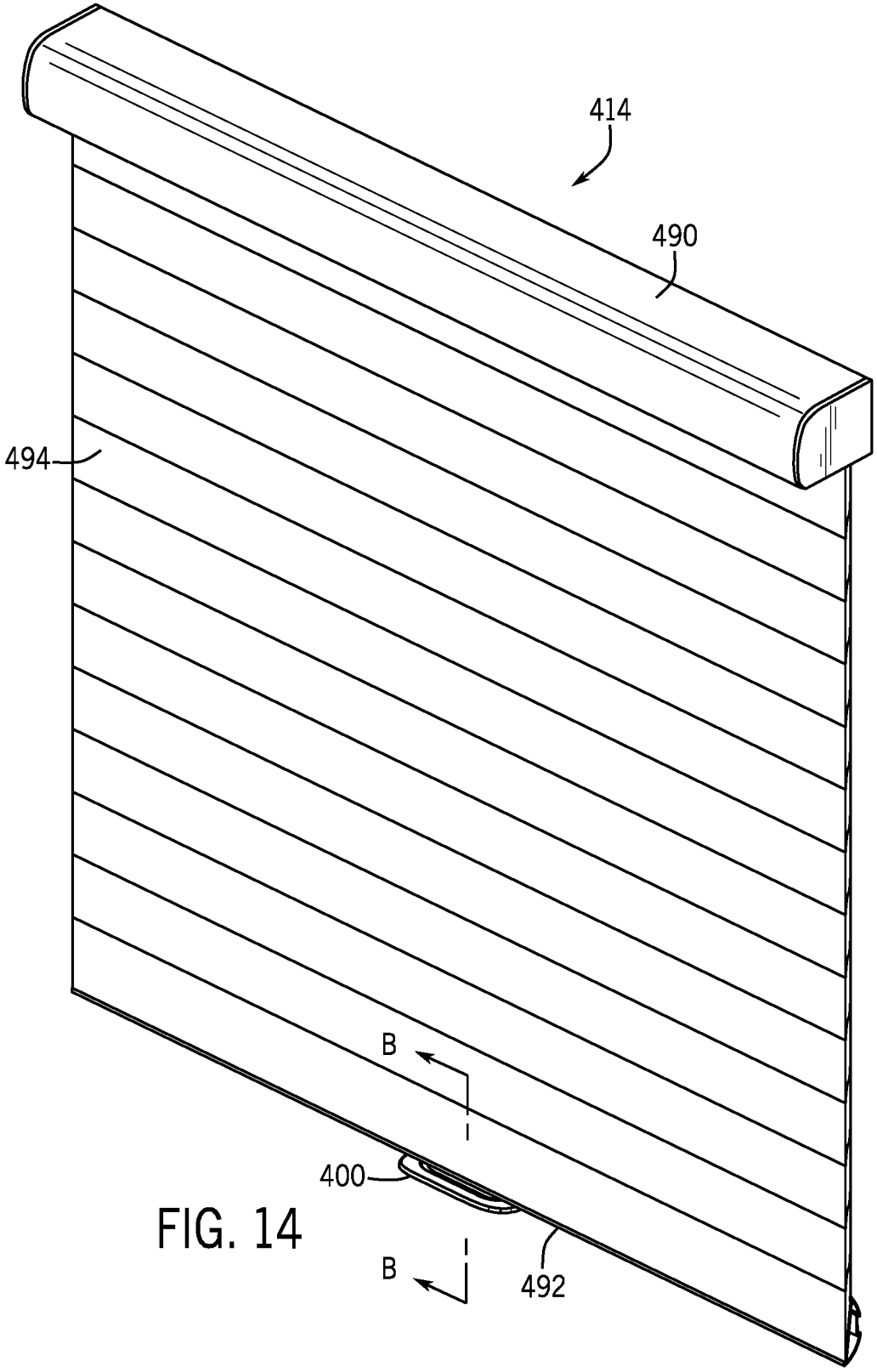
FIG. 14 shows a front perspective view of the covering of FIG. 13 in a closed configuration in accordance with an embodiment of the present disclosure.

Referring to FIG. 15, to couple handle assembly 400 to movable rail 492, handle assembly 400 may be positioned adjacent movable rail 492 so attachment portion 406 is in alignment with channel 514. The attachment portion 406 of handle assembly 400 may then be slid into channel 514 from one end (e.g., right side edge 508) towards the opposite end (e.g., left side edge 506) of movable rail 492. Once connected to movable rail 492, attachment portion 406 may be slid within channel 514 to position handle assembly 400 at substantially any desired location between the left and right side edges 506, 508 of movable rail 492. Depending on the particular application, the engagement between handle assembly 400 and movable rail 492 may limit lateral movement of handle assembly 400 relative to movable rail 492. For example without limitation, attachment portion 406 of handle assembly 400 and/or channel 514 of movable rail 492 may be sized and shaped such that attachment portion 406 is interference fit within channel 514. Once handle assembly 400 is coupled to movable rail 492, front portion 408 of first member 402 may be adjacent, and in some embodiments may extend beyond, front longitudinal edge 510 of movable rail 492. As shown in FIG. 13, second member 404 may extend beyond front longitudinal edge 510 of movable rail 492, though it is contemplated second member 404 may be positioned within the perimeter of movable rail 492 to achieve a desired aesthetic characteristic in some embodiments. Additionally or alternatively, in one embodiment, rear portion 410 of first member 402 may be adjacent rear longitudinal edge 512 of movable rail 492 (see FIG. 16). In such embodiments, hinge centerline 462 may be positioned adjacent rear longitudinal edge 512 of movable rail 492 between rear longitudinal edge 512 and channel 514. Though shown adjacent rear longitudinal edge 512 of movable rail 492, hinge centerline 462 may be positioned substantially anywhere between front and rear longitudinal edges 510, 512 to provide a desired point load or force distribution on movable rail 492. For example without limitation, hinge centerline 462 may be positioned to provide a substantially uniform force distribution on movable rail 492.

Figure 22:
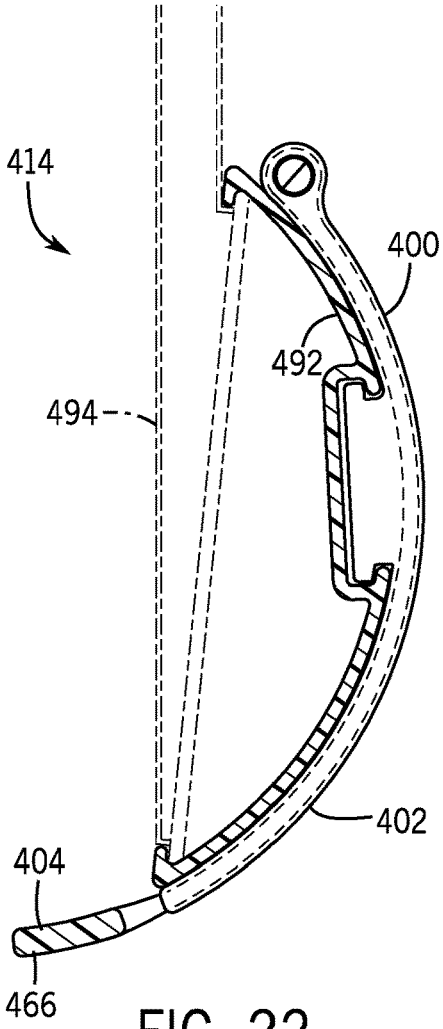
FIG. 22 shows an enlarged, cross-sectional view of the covering of FIG. 14 taken along line B-B of FIG. 14 in accordance with an embodiment of the present disclosure.
Figure 23:
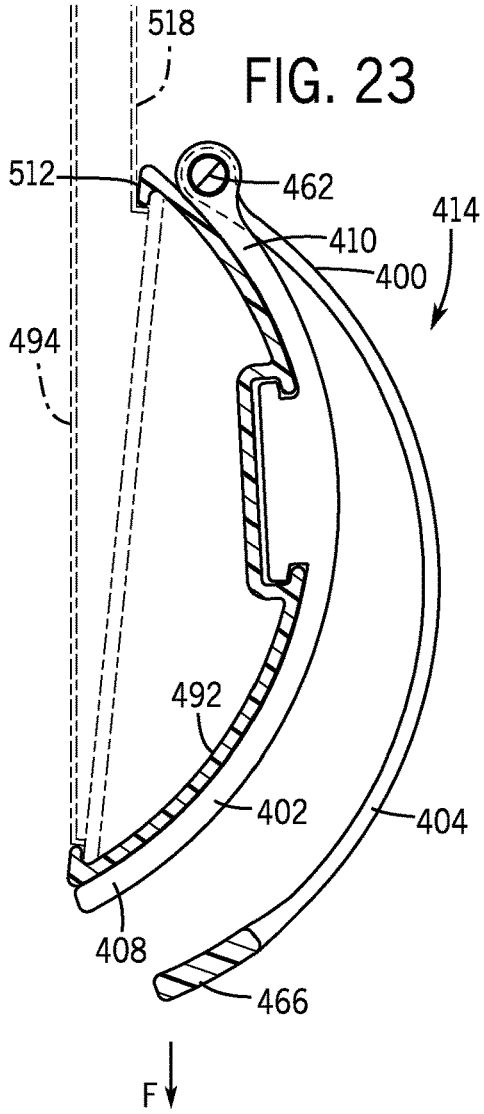
FIG. 23 shows an additional enlarged, cross-sectional view of the covering of FIG. 14 taken along line B-B of FIG. 14 in accordance with an embodiment of the present disclosure.
Figure 24:
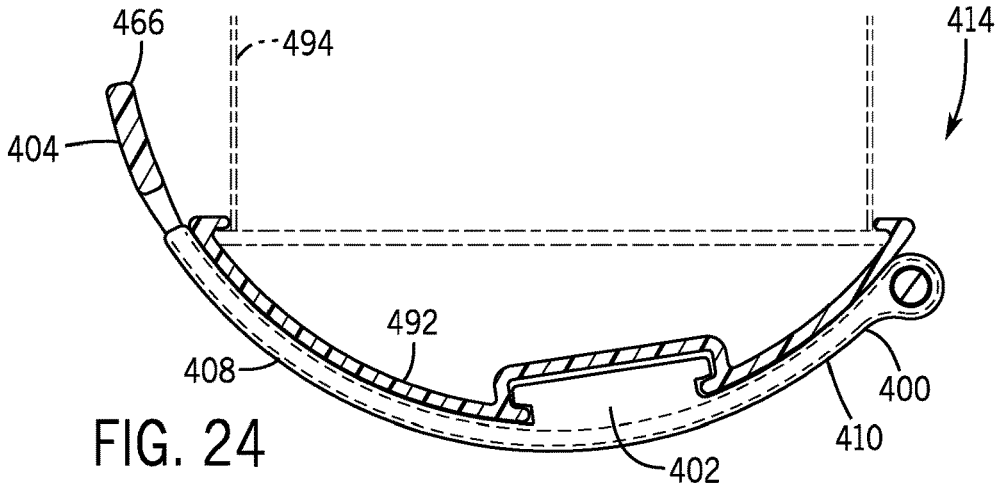
FIG. 24 shows an additional enlarged, cross-sectional view of the covering of FIG. 13 taken along line A-A of FIG. 13 in accordance with an embodiment of the present disclosure.

With reference to FIGS. 22-24, a user may actuate handle assembly 400 to move movable rail 492 across an architectural structure to cause covering 414 to transition between extended and retracted positions and/or to cause vanes 498 to transition between open and closed orientations. Referring to FIG. 23, to extend the covering 414 across the architectural structure, a user may grasp second member 404, such as at handle portion 450 and optionally at touch point 466 if provided, to rotate second member 404 away from the first member 402 in a first rotational direction (e.g., counter-clockwise in FIG. 23). As second member 404 (e.g., touch point 466) rotates away from first member 402 (e.g., from front portion 408), potential energy is stored in biasing member 470 tending to bias second member 404 to rotate in a second rotational direction (e.g., clockwise in FIG. 23) opposite the first rotational direction. Using second member 404, a user may then extend covering 414 across the architectural structure to a desired position such as by manipulating (e.g., pulling) handle portion 450, and optionally touch point 466 if provided, to move movable rail 492 in a first direction (e.g., downwards in FIG. 23) away from head rail 490. In this manner, a user may extend movable rail 492 across the architectural structure. Because hinge centerline 462 may be positioned adjacent rear longitudinal edge 512 of movable rail 492, an extension force F provided by the user to second member 404 may be directed to a rear portion (e.g., a rear sheet 518) of shade material 494, which may be desirable depending on the particular shade material 494, such as to move vanes 498 from the closed orientation to the open orientation by pulling on rear sheet 518 when shade material 494 is fully extended. Once in a desired position, the user may release second member 404 at which point second member 404 may rotate automatically towards first member 402 to its stored position (see FIG. 22). As explained in U.S. Publication No. 2014/0216666 A1, operating system 496 may apply a counterbalancing force to support shade material 494 at any level of extension selected by the user. In some embodiments, movable rail 492 may be manipulated to move vanes 498 between open and closed orientations. For instance, to open vanes 498, a user may rotate movable rail 492 in the second rotational direction to operate the vane orientation mechanism 500. For example, the user may grasp the front and/or rear portions 408, 410 of first member 402 to rotate movable rail 492 to move shade material 494 between open and closed positions.

Retracting the covering 414, if desired, may be accomplished in substantially reverse order as described above, thus allowing a user to select whether to have shade material 494 in a fully extended position, a fully retracted position, or any position in between. For example, to retract covering 414, the user may first rotate movable rail 492 in the first rotational direction such as through manipulation of front and/or rear portions 408, 410 of first member 402. In such embodiments, rotation of movable rail 492 in first rotational direction may operate vane orientation mechanism 500 to close vanes 498. The user may then lift movable rail 492, such as by the handle assembly 400, towards head rail 490 to a desired position providing a desired level of retraction. As noted above, the counterbalancing force applied by operating system 496 may support shade material 494 at any level of retraction selected by the user.

Handle assembly 400 and movable rail 492 may be constructed of substantially any type of material. For example, handle assembly 400 and movable rail 492 may be constructed or formed from natural and/or synthetic materials, including metals, ceramics, plastics, vinyl, and/or other suitable materials. Plastic materials may include thermoplastic material (self-reinforced or fiber-reinforced), ABS, polycarbonate, polypropylene, polystyrene, PVC, polyamide, or PTFE, among others. In some embodiments, movable rail 492 may be formed of extruded aluminum or another thermoformable material. Handle assembly 400 may be built, formed, molded, or non-molded in any suitable manner, such as by plug molding, blow molding, injection molding, milling or the like.

Whether handle structure 200 or handle assembly 400 are provided as external hardware for use with pre-existing window shades, or as a component of a system such as, e.g., window shading assembly 300 with an associated handle structure 200 and window shading 120, handle assembly 400 with vane orientation mechanism 500 communicatively coupled thereto, etc., embodiments of the disclosure can provide a safe, convenient, cordless actuation system for window shades, as discussed herein and shown in the accompanying FIGS. 4-24. Advantages of the embodiments described herein include low manufacturing costs comparable or even less than manual clutch systems, a simple installation or removal process, an unobtrusive appearance, reliable use over long periods, and the reduced requirement for a side-gap between the shade material and a window, e.g., by omitting the use of a loop-cord and clutch system, as found in a conventional window shading assembly. Embodiments of the present disclosure also provide a safe and convenient, cordless actuation system for window shadings. The system described herein has cost near to that of manual clutch systems, with easy installation and unobtrusive appearance, with reliable ease of use, and with preferable aesthetics due a handle member thereof being visually obscured by a bottom rail of the window assembly.

Additional or alternative embodiments of the present disclosure can include the following subject matter, without limitation:

A handle structure for a bottom rail of a window covering, said handle structure including: a handle member having a first end pivotably coupled to the bottom rail, and a second end having a free end for gripping the handle member; and a biasing element biasing said handle member to a closed position in which said handle member is proximal to said bottom rail, wherein, in response to a downward force being applied to said free end, said handle member pivots away from the bottom rail against the biasing of said biasing element and transfers the downward force to the rear side of the bottom rail.

The handle structure described herein, wherein the handle member is pivotably coupled to the bottom rail at a position between said rear facing and a window.

The handle structure described herein, wherein said handle member is contoured to substantially correspond to a contour of the bottom rail.

The handle structure described herein, wherein said handle member in the closed position is positioned directly vertically beneath said bottom rail.

The handle structure described herein, wherein said biasing element includes one of a torsion spring, a torsion bar, and a resinous material.

The handle structure described herein, wherein said handle structure is mechanically coupled to a ratcheting mechanism of the window shading through one of the two facings of the window shading, such that the downward force is applied to the ratcheting mechanism of the window shading along one of a front side or a rear side of the ratcheting mechanism.

The handle structure described herein, wherein the one of the two facings directs the downward force to a side of the ratcheting mechanism at a point where the one of the two facings is coupled to a roller of the window shading.

The handle structure described herein, further comprising a handle coupled to said handle member, wherein said handle protrudes outward from the bottom rail of the window shading when said handle member is in the closed position.

An assembly comprising: a window shading including a first facing, a second facing opposed to the first facing, and a plurality of vanes extending between said first facing and said second facing; a roller configured to receive said first and second facings of said window shading; a bottom rail coupled to said first and second facings of said window shading at ends of said first and second facings opposite said roller; a handle member having a first end pivotably coupled to said bottom rail, and including a second end on which a free end is formed; and a biasing element biasing said handle member to a closed position in which said handle member is proximal to said bottom rail, wherein, in response to a downward force being applied to said free end, said handle member pivots away from said bottom rail against the biasing of said biasing element and transfers the downward force to said rear side of said bottom rail.

The assembly described herein, further comprising a handle coupled to said free end, wherein said handle protrudes outward from said bottom rail of said window shade.

The assembly described herein, further comprising a ratcheting mechanism coupled to said roller and selectable between a loaded position and an unloaded position, wherein the unloaded position mechanically biases said plurality of vanes in one of an open position and a closed position, and wherein the loaded position mechanically biases said plurality of vanes in the other of the open position and the closed position.

The assembly described herein, wherein said ratcheting mechanism is further selectable between a plurality of partially-loaded positions, each of the plurality of partially-loaded positions corresponding to one of a plurality of partially open positions of said plurality of vanes.

The assembly described herein, wherein said handle member is mechanically coupled to said ratcheting mechanism through said rear facing, such that the downward force is applied to said ratcheting mechanism to select between the loaded and unloaded position thereof.

The assembly described herein, wherein said handle member, in the closed position, extends along said bottom rail.

The assembly described herein, wherein said handle member is contoured to substantially correspond to a contour of said bottom rail.

The assembly described herein, wherein said biasing element includes a torsion-based biasing mechanism.

The assembly described herein, wherein said biasing element includes one of a torsion spring, a torsion bar, and a resinous material.

A window shading comprising: a roller; a window covering coupled to said roller; a ratcheting mechanism coupled to said window covering, said ratcheting mechanism being selectable between a loaded position and an unloaded position, wherein the unloaded position mechanically biases said window covering in one of an open position and a closed position, and wherein the loaded position mechanically biases said window covering in the other of the open position and the closed position; a bottom rail coupled to an end of said window covering opposite said roller; and a handle structure including: a handle member having a first end pivotably coupled to said handle, and a second end on which a free end is formed; and a biasing element biasing said handle member to a handle member closed position in which said handle member is proximal to said bottom rail, wherein, in response to a downward force being applied to said free end, said handle member pivots away from said bottom rail against the biasing of said biasing element and transfers the downward force to said rear side of said bottom rail and to a rear side of the ratcheting mechanism to cause actuation of the ratcheting mechanism.

The window shading described herein, wherein said biasing element includes one of a torsion spring, a torsion bar, and a resinous material.

The window shading described herein, wherein said handle structure is mechanically coupled to said ratcheting mechanism through said rear facing, such that the downward force is applied to said ratcheting mechanism to select between the loaded and unloaded position thereof.

The corresponding structures, materials, acts, and equivalents of all means or step plus function elements in the claims below are intended to include any structure, material, or act for performing the function in combination with other claimed elements as specifically claimed. The description of the present disclosure has been presented for purposes of illustration and description, but is not intended to be exhaustive or limited to the disclosure in the form disclosed. Many modifications and variations will be apparent to those of ordinary skill in the art without departing from the scope and spirit of the disclosure. The embodiment was chosen and described in order to best explain the principles of the disclosure and the practical application, and to enable others of ordinary skill in the art to understand the disclosure for various embodiments with various modifications as are suited to the particular use contemplated.

The terminology used herein is for the purpose of describing particular embodiments only and is not intended to be limiting of the disclosure. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

We claim:

1. A handle assembly for an architectural covering, said handle assembly comprising:

a first member including opposing front and rear portions, and configured for attachment to a bottom rail of the architectural covering such that the first member is positioned beneath the bottom rail of the architectural covering;

a second member pivotably attached to said rear portion of said first member at a hinge assembly, and mechanically coupled to a ratcheting mechanism of the architectural covering through the front portion or the rear portion of said first member, wherein said second member is pivotable about an axis anterior to the bottom rail of the architectural covering between:

a stored position in which said second member extends adjacent said front portion of said first member such that said second member extends substantially in parallel with said first member, and a use position in which said second member is pivoted away from said front portion of said first member such that the second member is substantially aligned with said rear portion of said first member, and horizontally displaced from said front portion of said first member, wherein said second member in said use position is configured to apply a downward force to the ratcheting mechanism through the front portion or the rear portion of said first member; and a biasing member operable to bias said second member to said stored position.

2. The handle assembly of claim 1, wherein said handle assembly includes a shaft;

said second member includes a handle portion extending from said shaft; and said shaft is received at least partially within a bore defined in said rear portion of said first member to define said hinge assembly.

3. The handle assembly of claim 2, wherein said biasing member is one of a torsion spring or a torsion bar engaged with said first and second members.

4. The handle assembly of claim 1, wherein in said stored position said biasing member is positioned at least partially between said first and second members.

5. The handle assembly of claim 1, wherein said biasing member is positioned at least partially between said first and second members.

6. The handle assembly of claim 1, wherein said first member includes an attachment portion configured for coupling to the bottom rail and positioned between said front and rear portions, said attachment portion extending away from said second member.

7. The handle assembly of claim 1, wherein:

said first member includes an exterior surface and a plurality of grooves defined in said exterior surface; and said second member is at least partially received in said plurality of grooves in said stored position.

8. The handle assembly of claim 1, wherein said second member includes a touch point; and said touch point is positioned on an opposite side of said handle assembly relative to said hinge assembly.

9. The handle assembly of claim 1, wherein said second member is contoured to substantially correspond to a contour of the first member.

10. The handle assembly of claim 9, wherein said second member in the stored position is positioned directly vertically beneath said first member.

11. The handle assembly of claim 1, wherein said biasing member includes a resinous material.

12. The handle assembly of claim 1, wherein said second member is mechanically coupled to the ratcheting mechanism of the architectural covering through the front or rear portion of said first member, such that the downward force is applied to the ratcheting mechanism of the architectural covering along one of a front side or a rear side of the ratcheting mechanism.

13. The handle assembly of claim 12, wherein said front portion or said rear portion of said first member directs the downward force to a side of the ratcheting mechanism at a point where the one of said front portion or said rear portion of the first member is coupled to a roller of the architectural covering.

14. The handle assembly of claim 1, further comprising a handle coupled to said second member, wherein said handle protrudes outward from said first member of the handle assembly when said second member is in the stored position.

15. An architectural covering comprising:

a shade material;

a movable rail attached to said shade material and including a groove extending along a longitudinal length of said movable rail; and a handle assembly at least partially received within said groove, said handle assembly including:

a first member including opposing front and rear portions, and configured for attachment to the moveable rail such that the first member is positioned beneath the moveable rail;

a second member pivotably attached to said rear portion of said first member at a hinge assembly, and mechanically coupled to a ratcheting mechanism of the architectural covering through the front portion or the rear portion of said first member, wherein said second member is pivotable about an axis anterior to the moveable rail between:

a stored position in which said second member extends adjacent said front portion of said first member such that said second member extends substantially in parallel with said first member, and a use position in which said second member is pivoted away from said front portion of said first member such that the second member is substantially aligned with said rear portion of said first member, and horizontally displaced from said front portion of said first member, wherein said second member in said use position is configured to apply a downward force to the ratcheting mechanism through the front portion or the rear portion of said first member; and a biasing member operable to bias said second member towards said first member.

16. The covering of claim 15, wherein said first member includes an attachment structure operable to couple said first member to said movable rail.

17. The covering of claim 16, wherein said attachment structure includes an attachment portion received within said groove of said movable rail.

18. The covering of claim 17, wherein said attachment portion and said movable rail define complementary hooks to secure said handle assembly to said movable rail.

19. The covering of claim 17, wherein:

said movable rail includes opposing front and rear longitudinal edges;

said first member includes opposing front and rear portions;

said front portion extends adjacent said front longitudinal edge; and said rear portion extends adjacent said rear longitudinal edge.

20. The covering of claim 15, wherein said hinge assembly includes a hinge centerline positioned adjacent a rear edge of said movable rail.

21. A method of extending a movable rail of an architectural covering across an architectural structure via the handle assembly of claim 1, said method comprising:

pivoting the second member away from the first member to the use position, such that the second member in the use position is substantially aligned with the rear portion of the first member, and horizontally displaced from the front portion of the first member;

extending the movable rail across the architectural structure by applying an extension force to the second member; and once in a desired position, releasing the second member so the second member pivots automatically about the axis anterior to the moveable rail of the architectural covering towards the stored position in which the second member extends adjacent the front portion of said first member, such that the second member extends substantially in parallel with the first member.

22. The method of claim 21, further comprising rotating the movable rail to open and close the covering by manipulating the first member.

23. The method of claim 21, wherein the handle assembly is attached to the movable rail through the first member.

* * * * *